US007606702B2

(12) United States Patent
Tanaka et al.

(10) Patent No.: US 7,606,702 B2
(45) Date of Patent: Oct. 20, 2009

(54) SPEECH DECODER, SPEECH DECODING METHOD, PROGRAM AND STORAGE MEDIA TO IMPROVE VOICE CLARITY BY EMPHASIZING VOICE TRACT CHARACTERISTICS USING ESTIMATED FORMANTS

(75) Inventors: Masakiyo Tanaka, Kawasaki (JP); Masanao Suzuki, Kawasaki (JP); Yasuji Ota, Kawasaki (JP); Yoshiteru Tsuchinaga, Yokohama (JP)

(73) Assignee: Fujitsu Limited, Kawasaki (JP)

( * ) Notice: Subject to any disclaimer, the term of this patent is extended or adjusted under 35 U.S.C. 154(b) by 297 days.

(21) Appl. No.: 11/115,478

(22) Filed: Apr. 27, 2005

(65) Prior Publication Data

US 2005/0187762 A1 Aug. 25, 2005

Related U.S. Application Data

(63) Continuation of application No. PCT/JP03/05582, filed on May 1, 2003.

(51) Int. Cl.
*G10L 21/02* (2006.01)
*G10L 19/06* (2006.01)

(52) U.S. Cl. ..... 704/209; 704/224; 704/219

(58) Field of Classification Search ..... None
See application file for complete search history.

(56) References Cited

U.S. PATENT DOCUMENTS

| | | | | |
|---|---|---|---|---|
| 4,903,303 | A | 2/1990 | Taguchi | |
| 5,327,521 | A * | 7/1994 | Savic et al. | 704/272 |
| 5,732,188 | A | 3/1998 | Moriya et al. | |
| 5,819,213 | A * | 10/1998 | Oshikiri et al. | 704/222 |
| 5,926,785 | A * | 7/1999 | Akamine et al. | 704/219 |
| 6,003,000 | A | 12/1999 | Ozzimo et al. | |
| 6,064,962 | A | 5/2000 | Oshikiri et al. | |
| 6,098,036 | A | 8/2000 | Zinser, Jr. et al. | |
| 6,665,638 | B1 * | 12/2003 | Kang et al. | 704/224 |

FOREIGN PATENT DOCUMENTS

| | | |
|---|---|---|
| EP | 0 731 449 | 9/1996 |
| EP | 0 742 548 | 11/1996 |
| EP | 0 763 818 | 3/1997 |
| EP | 1 557 827 | 7/2005 |

(Continued)

OTHER PUBLICATIONS

K. Nakata. Highly Efficient Encoding of Speech. Morikita Publishing Co. Ltd. with partial translation.

(Continued)

*Primary Examiner*—Talivaldis Ivars Smits
(74) *Attorney, Agent, or Firm*—Katten Muchin Rosenman LLP

(57) ABSTRACT

A code separation/decoding unit restores a vocal tract characteristic $sp_1$ and a vocal source signal $r_1$. A vocal tract characteristic modification unit modifies the vocal tract characteristic $sp_1$ and outputs the modified vocal tract characteristic $sp_2$. In this method, an emphasized vocal tract characteristic $sp_2$ is generated to output by applying formant emphasis, using amplification ratios calculated based on estimated formants, directly to the vocal tract characteristic $sp_1$ for instance. A signal synthesis unit synthesizes the modified vocal tract characteristic $sp_2$ and the vocal source signal $r_1$ to generate and output an output voice, s.

9 Claims, 22 Drawing Sheets

FOREIGN PATENT DOCUMENTS

| | | |
|---|---|---|
| JP | 05-323997 | 12/1993 |
| JP | 6-202695 | 7/1994 |
| JP | 06-202698 | 7/1994 |
| JP | 7-038118 | 2/1995 |
| JP | 7-038118 | 4/1995 |
| JP | 08-006596 | 1/1996 |
| JP | 8-248996 | 9/1996 |
| JP | 8-272394 | 10/1996 |
| JP | 9-81192 | 3/1997 |
| JP | 09-138697 | 5/1997 |
| JP | 10-105200 | 4/1998 |
| JP | 2000-099094 | 4/2000 |
| JP | 2001-117573 | 4/2001 |
| JP | 2001117573 | 4/2001 |
| JP | 2001-242899 | 9/2001 |
| JP | 2004-086102 | 3/2004 |

OTHER PUBLICATIONS

Supplementary European Search Report dated Jul. 3, 2007, from the corresponding European Application.
Notice of Rejection Ground, dated Sep. 30, 2008, for corresponding Japanese Patent Application 2004-571323.

* cited by examiner (b)

(a)

SPEECH DECODER, SPEECH DECODING METHOD, PROGRAM AND STORAGE MEDIA TO IMPROVE VOICE CLARITY BY EMPHASIZING VOICE TRACT CHARACTERISTICS USING ESTIMATED FORMANTS

CROSS-REFERENCE TO RELATED APPLICATIONS

This application is a continuation of International Application No. PCT/JP2003/005582, which was filed on May 1, 2003, the contents of which are herein wholly incorporated by reference.

BACKGROUND OF THE INVENTION

1. Field of the Invention

The present invention relates to a communication apparatus such as a mobile phone communicating through speech coding processing, particularly a speech decoder, speech decoding method, et cetera, comprised by the communication apparatus to improve voice clarity for ease of hearing of the received voice.

2. Description of the Related Art

Mobile phones have become widely spread in recent years. In mobile phone systems, speech coding techniques are used for compressing the voice in order to better utilize communication lines. Among such speech coding techniques, the CELP (Code Excited Linear Prediction) system is known as a coding method for providing good voice quality at a low bit rate and the CELP-based coding method is adopted by many voice coding standards such as ITU-T G. 729 system, 3GPP AMR system, et cetera. The CELP algorithm-based method is also the most commonly used technique for voice compression used for VoIP (Voiceover Internet Protocol), video conference system, et cetera, and is not limited to the mobile phone system.

Here, CELP is summarized. A speech coding method introduced by Messrs. M. R. Schroder and B. S. Atal in 1985, the CELP extracts parameters from the input voice based on a human voice creation model for transmitting the parameters through coding, thereby accomplishing highly efficient information compression.

FIG. 16 shows a voice creation model, in the process of which a vocal source signal generated by a vocal source (i.e., vocal chords) 110 is input to an articulatory system (i.e., vocal tract) 111, where a vocal tract characteristic is added, and a voice wave is finally output from the lips 112 (refer to the non-patent document 1). That is, the voice is made up of vocal source and vocal tract characteristics.

FIG. 17 shows the process flow of CELP coding and decoding.

FIG. 17 shows how a CELP coder and decoder are equipped in a mobile phone for example, and a voice signal (i.e., voice code code) is transmitted from the CELP coder 120 equipped in the transmitting mobile phone to the CELP decoder 130 equipped in the receiving mobile phone by way of a transmission path (not-shown; e.g., wireless communication line, mobile phone network, et cetera).

In the CELP coder 120 equipped in the transmitting mobile phone, a parameter extraction unit 121 analyzes the input voice based on the above mentioned voice generation model to separate the input voice into LPC (Linear Predictor Coefficients) indicating the vocal tract characteristics and a vocal source signal. The parameter extraction unit 121 further extracts an ACB (Adaptive CodeBook) vector indicating a cyclical component of the vocal source signal, an SCB (Stochastic CodeBook) vector indicating a non-cyclical component thereof, and a gain of each vector.

Then a coding unit 122 codes the LPC, ACB vector, SCB vector and the gain to generate the LPC code, ACB code, SCB code and gain code so that a code multiplexer unit 123 multiplexes them to generate a voice code code to transmit to the receiving mobile phone.

In the CELP decoder 130 equipped in the receiving mobile phone, a code separation unit 131 first separates the transmitted voice code code into the LPC code, ACB code, SCB code and gain code so that a decoder 132 decodes them to the LPC, ACB vector, SCB vector and gain, respectively. Then a voice synthesis unit 133 synthesizes a voice according to the decoded parameters.

The following detailed descriptions are of the CELP coder and the CELP decoder.

FIG. 18 is a block diagram of parameter extraction unit 121 equipped in the CELP coder.

In the CELP, an input voice is coded in the unit of frames of a certain length. First, an LPC analysis unit 141 calculates an LPC from the input voice according to a known LPC (Linear Prediction Coefficients) analysis method. The LPC is a filter coefficient when a vocal tract characteristic is approximated by an all pole linear filter.

Next, extracts a vocal source signal by using an AbS (Analysis by Synthesis) method. In the CELP, a voice is reproduced by inputting a vocal source signal to an LPC synthesis filter 142 constituted by the LPC. Therefore, a differential power evaluation unit 145 searches a combination of the CodeBooks where a differential error with the input voice becomes a minimum when a voice is synthesized by the LPC synthesis filter 142 from among the voice source candidates constituted by combinations among a plurality of ACB vectors stored in an ACB 143, a plurality of SCB vectors stored in an SCB 144 and the gains of the aforementioned two vectors to extract an ACB vector, SCB vector, ACB gain and SCB gain.

As described above, the coding unit 122 codes each parameter extracted by the above described operation to obtain an LPC code, ACB code, SCB code and gain code. The code multiplexer unit 123 multiplies each obtained code to transmit to the decoding side as a voice code code.

The next description is of the CELP decoder in further detail.

FIG. 19 shows a block diagram of the CELP decoder 130.

In the CELP decoder, the code separation unit 131 separates each parameter from the transmitted voice code code as described above to obtain an LPC code, an ACB code, an SCB code and a gain code.

Next, an LPC decoder 151, ACB vector decoder 152, SCB vector decoder 153 and gain decoder 154 all constituting the decoding unit 132 respectively decode the LPC code, the ACB code, the SCB code and the gain code to obtain an LPC, an ACB vector, an SCB vector and the gains (i.e., ACB gain and SCB gain), respectively.

The voice synthesis unit 133 generates a vocal source signal from the input ACB vector, SCB vector and the gains (i.e., ACB gain and SCB gain) by the shown configuration, and inputs the vocal source signal into the LPC synthesis filter 155 structured by the above described decoded LPC to thereby decode and output a voice.

Incidentally, a mobile phone is often used not only in a quiet place but also in a noisy environment surrounded by noise such as an airport or the platform of a railway station. In such a case the remote user is faced with a problem of difficulty in hearing the received voice impaired by the ambient noise. Not only that, in a video conference system for instance, which is usually used at home the user is surrounded by background noises such as those emitted by electric appliances such as air conditioners and the noise of the activity of people nearby.

As a countermeasure to such problems there are several known techniques to improve a received voice by improving clarity thereof by emphasizing the formants of the frequency spectrum of the receiving voice.

The following is a brief description of formants.

FIG. 20 exemplifies a frequency spectrum of a voice.

There is usually a plurality of peaks (showing relative maximum values) in the frequency spectrum of a voice, which are called formants. FIG. 20 exemplifies a spectrum with three formants (i.e., peaks), which are referred to as first, second and third formants from the lower frequency toward the higher frequency. The frequencies with relative maximum values, that is, the frequency of each of the formants, fp(1), fp(2) and fp(3), is called a formant frequency. Generally speaking, a frequency spectrum of a voice has the characteristic of the amplitude (i.e., power) decreasing with the frequency. Furthermore, it is known that the clarity of a voice is closely related with its formants, with an improved level of clarity possible by emphasizing the formants of higher levels (e.g., second and third formants).

FIG. 21 exemplifies formant emphasis on a voice spectrum.

The wave delineated by the solid line in FIG. 21 (*a*), and the wave delineated by the dotted line in FIG. 21 (*b*) are voice spectra before an emphasis. The wave delineated by the solid line in FIG. 21 (*b*) shows a voice spectrum after emphasis. The straight line in the figure indicates the inclination of the spectrum.

It is known that emphasizing the voice spectrum so as to increase the amplitude of higher level formants, flattening the inclination of whole spectrum as shown by FIG. 21 (*b*), improves the clarity of entire voice.

The, following techniques are known as such formant emphasis techniques.

The technique noted by the patent document 1 is an example of applying formant emphasis to a coded voice.

FIG. 22 shows a basic configuration of the invention noted in the patent document 1 which relates to a technique using a band division filter. As understood by FIG. 22, in the technique noted by the patent document 1, a spectrum estimation unit 160 figures out the spectrum of the input voice, and the convex/concave band decision unit 161 determines convex (i.e., peak) and concave (i.e., trough) bands based on the calculated spectrum and calculates an amplification ratio (or attenuation ratio) for the convex and concave bands.

Then, a filter configuration unit 162 provides a filter unit 163 with a coefficient for accomplishing the above described amplification ratio (or attenuation ratio) and inputs the input voice to the filter unit 163 for spectrum emphasis.

There has been a problem of emphasizing components other than the formants resulting in a degraded clarity, associated with the method using the band division filter because there has conventionally been no guarantee that a voice formant will be included in each frequency band.

Contrarily, the method noted by the patent document 1, being a method based on a band division filter, respectively amplifies and attenuates the peaks and troughs of the voice spectrum individually, thereby accomplishing emphasis of the voice.

Furthermore in the patent document 1, a voice decoding unit decodes an ABC vector, SCB vector and gains to generate a vocal source by using an ABC vector index, SCB vector index and gain index to generate a synthesis signal by filtering the voice source with a synthesis filter constituting an LPC decoded by the LPC index in the case of using the CELP method as presented by the seventh embodiment shown by FIG. 19 therein. Then the above described spectrum emphasis is accomplished by input of the synthesis signal and LPC to a spectrum emphasis unit.

Meanwhile, the invention proposed by patent document 2, being a voice signal processing apparatus applying to a post filter for a voice synthesis system comprised of a voice decoding apparatus for MBE (Multi-Band Excitation coding), is characterized by emphasizing the formants in the high frequencies of a frequency spectrum by maneuvering directly the amplitude value of each band as a parameter for frequency area. The formant emphasis method proposed in the patent document 2 is one estimating a band containing a formant based on the average amplitude of a plurality of frequency bands divided in accordance with a pitch frequency in the MBE method.

Meanwhile, the invention proposed by patent document 3, being an "analysis method by synthesis" with a reference signal which is a signal suppressing a noise gain, that is, a voice coding apparatus performing coding processing by using the A-b-S method, comprises a series of means for emphasizing the formant of the reference signal, dividing a signal into a voice component and a noise component and suppressing the level of the noise component. In the processing, an LPC is extracted from the input signal frame by frame and the above described formant emphasis is applied based on the LPC.

Meanwhile, the invention proposed by patent document 4 relates to a vocal source search (i.e., multi-pass search) for multi-pass voice coding, that is, aiming to improve the compression efficiency by searching a vocal source after emphasizing the voice in the linear spectrum, instead of searching the vocal source by using the input voice as is when searching the vocal source information through approximating by multi-pass.

[Patent document 1] Japanese unexamined patent application publication No. 2001-117573

[Patent document 2] Japanese unexamined patent application publication No. 6-202695

[Patent document 3] Japanese unexamined patent application publication No. 8-272394

[Patent document 4] Japanese registered patent No. 7-38118

[Non-patent document 1] "High efficiency coding of voice" authored by Kazuo Nakata pp. 69 through 71; published by Morikita Shuppan Co., Ltd.

The above noted conventional techniques are faced with problems respectively as described in the following.

First of all, the method noted in the patent document 1 is faced with the following problem.

As noted above, the patent document 1 shows an example method in the seventh embodiment shown by FIG. 7 therein to accomplish spectrum emphasis by the input of a synthesis signal and LPC to the spectrum emphasis unit, corresponding to the case of using the CELP method. A vocal source signal, however, is different from a vocal tract characteristic as understood by the above described voice generation model. The difference notwithstanding, the method noted by the patent document 1 makes it possible for a synthesized voice be emphasized by the emphasis filter obtained from the vocal tract characteristic, causing an enlarged distortion of the vocal source signal contained by the synthesized voice, sometimes resulting in side effects such as an increased sense of noise and a degraded clarity.

Meanwhile, the invention proposed by the patent document 2 aims at improving the quality of voice reproduced by an MBE vocoder (i.e., voice coder) as described above. Currently the mainstream technique of voice compression systems used for mobile phone systems, VoIP, video conference systems, et cetera, is based on the CELP algorithm using linear prediction. Therefore, an application of the technique noted by the patent document 2 is faced with the problem of further degradation of voice quality because the coding parameters for the MBE vocoder are extracted from a degraded quality of voice having been compressed and decompressed.

Meanwhile, the invention proposed by the patent document 3 makes it possible for a simple IIR filter using an LPC for emphasizing the formant, which is known as emphasizing the formant erroneously through a published research paper (e.g., Acoustical Society of Japan: Lecture Papers; published in March 2000; pp. 249 and 250), et cetera. In addition, the invention proposed by the patent document 3 basically relates to a voice coding apparatus instead of a voice decoding apparatus.

Meanwhile, the invention proposed by the patent document 4 aims at improving the efficiency of compression by searching a vocal source and specifically, when searching voice information through approximation by multi-pass, by searching the vocal source after emphasizing the voice in a linear spectrum instead of using the input voice as is, not aiming at clarity of voice.

The challenge of the present invention is to provide a speech decoder, a speech decoding method, the program thereof and a storage media for suppressing side effects of formant emphasis such as a degradation of voice quality and an increased sense of noisiness, and improving the clarity of reproduced voice and easy hearing of the receiving voice in equipment (e.g., mobile phone) using a speech coding method of an analysis-synthesis system.

SUMMARY OF THE INVENTION

A speech decoder according to the present invention, in the speech decoder comprised by a communication apparatus using a voice coding method in an analysis-synthesis system, comprises a code separation/decoding unit for restoring a vocal tract characteristic and a vocal source signal by separating a received voice code; a vocal tract characteristic modification unit for modifying the vocal tract characteristic; and a signal synthesis unit for outputting a voice signal by synthesizing the modified vocal tract characteristic modified by the vocal tract characteristic modification unit and the vocal source signal obtained from the voice code.

The above noted modification of vocal tract characteristics is for instance an application of formant emphasis to the vocal tract characteristic.

The above configured speech decoder, in the speech decoder comprised by a communication apparatus such as a mobile phone using a voice coding method in an analysis-synthesis system, having received a voice code transmitted following an application of voice coding processing thereto, restores a vocal tract characteristic and vocal source signal from the voice code, applies formant emphasis processing to the restored vocal tract characteristic to synthesize with the vocal source signal to output when generating a voice based on the voice code.

This suppresses distortion of the spectrum occurring when applying such emphasis to a vocal tract characteristic and a vocal source signal simultaneously, which has been a problem with conventional techniques, thereby improving voice clarity. That is, it is possible to decode a voice without causing a side effect such as degraded voice quality and an increased sense of noise by emphasis processing, hence further improving voice clarity for ease of hearing.

For instance, the vocal tract characteristic is a linear predictor spectrum calculated based on a first linear predictor coefficient decoded from the voice code; the vocal tract characteristic modification unit applies a formant emphasis to the linear predictor spectrum; and the signal synthesis unit comprises a modified linear predictor coefficient calculation unit for calculating a second linear predictor coefficient corresponding to the formant emphasized linear predictor spectrum and a synthesis filter configured by the second linear predictor coefficients, and generates the voice signal to output by inputting the vocal source signal into the synthesis filter.

Meanwhile, in the above configured speech decoder, an alternative configuration may be such that, for instance, the vocal tract characteristic modification unit applies formant emphasis processing to the vocal tract characteristic and attenuation processing to an anti-formant, and generates a vocal tract characteristic emphasizing the amplitude difference between a formant and an anti-formant, and the signal synthesis unit synthesizes the vocal source signal based on the emphasized vocal tract characteristic.

The above described configuration makes it possible to emphasize the formant more to further improve voice clarity. Attenuating the anti-formant suppresses a sense of noisiness that tends to be accompanied by a decoded voice after the application of voice coding. That is, a voice which is coded and then decoded by a voice coding method such as the CELP as one thereof in an analysis-synthesis system is known to tend to accompany a noise called quantization noise to the anti-formant. Contrarily in the present invention, the above described configuration attenuates the anti-formant, thereby reducing the above described quantized noise and accordingly providing a voice with little sense of noisiness and that can easily be heard.

Meanwhile, in the above configured speech decoder, an alternative configuration may further comprises, for instance, a pitch emphasis unit for applying pitch emphasis to the vocal source signal, wherein the signal synthesis unit synthesizes the pitch emphasized vocal source signal and the modified vocal tract characteristic to generate and output a voice signal.

The above described configuration restores a vocal source characteristic (i.e., residual differential signal) and a vocal tract characteristic by separating an input voice code and applies the appropriate emphasis processes to the respective characteristics, that is, emphasizing a pitch cyclicality of the vocal source characteristic and a formant emphasis of the vocal tract characteristic, thereby making it possible to further improve output voice clarity.

In the meantime, the above described problem can also be solved by a computer executing a program by reading from a computer readable storage medium storing the program for the computer to accomplish the same controls as the respective functions of the above described configurations according to the present invention.

BRIEF DESCRIPTION OF THE DRAWINGS

The present invention will be more apparent from the following detailed description when the accompanying drawings are referred to.

DESCRIPTION OF THE PREFERRED EMBODIMENTS

An embodiment of the present invention will be described while referring to the accompanying drawings as follows.

Figure 1:
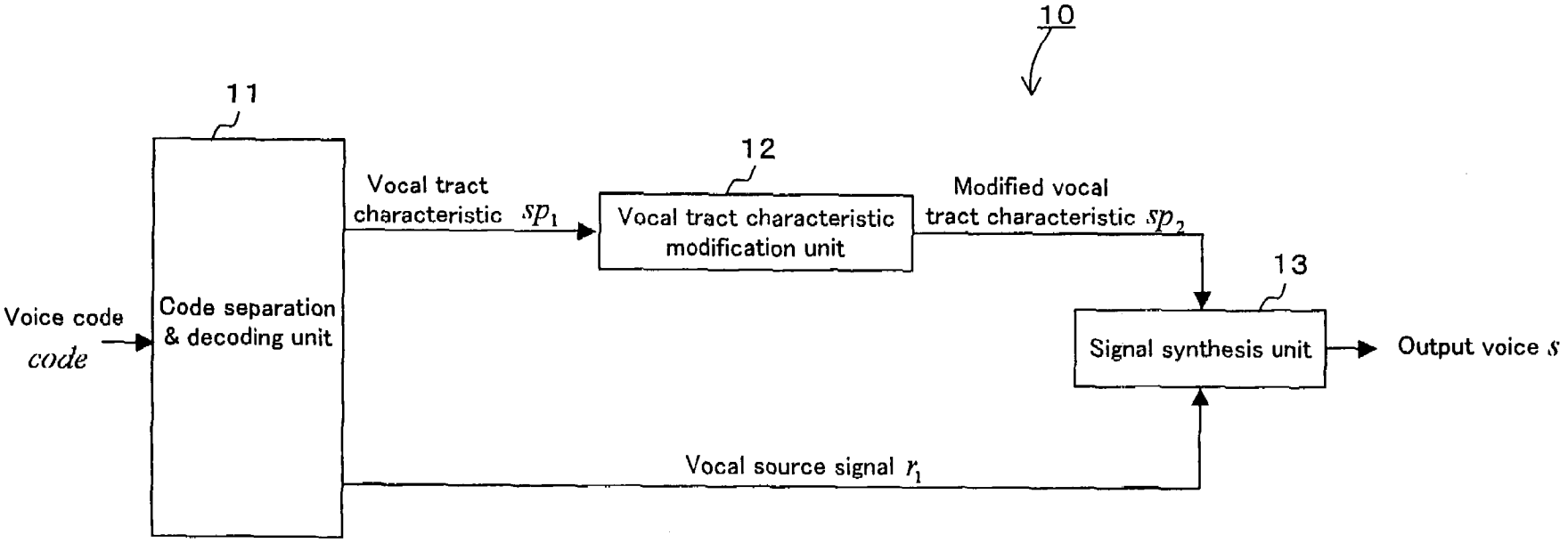
FIG. 1 illustrates an overview configuration of speech decoder of the present embodiment.

FIG. 1 illustrates a summary configuration of a speech decoder of the present embodiment.

As shown by FIG. 1, the speech decoder 10 comprises a code separation/decoding unit 11, a vocal tract characteristic modification unit 12 and a signal synthesis unit 13 as an overview configuration.

The code separation/decoding unit 11 restores a vocal tract characteristic $sp_1$ and a vocal source signal $r_1$ from a voice code code (N.B: the last "code" herein denotes a component name). As described above, a CELP coder (not shown) comprised by a mobile phone, et cetera, separates an input voice into LPCs (Linear Prediction Coefficients) and a vocal source signal (i.e., residual differential signal), codes them respectively and multiplexes them for transmission to the receiving decoder comprised by a mobile phone, et cetera, as a voice code code.

The decoder receives the voice code code, and the code separation/decoding unit 11 decode the vocal tract characteristic $sp_1$ and the vocal source signal $r_1$ from the voice code code as described above. Then, the vocal tract characteristic modification unit 12 modifies the vocal tract characteristic $sp_1$ to output a modified vocal tract characteristic $sp_2$. This means generating and outputting an emphasized vocal tract characteristic $sp_2$ by directly applying formant emphasis processing to the vocal tract characteristic $sp_1$ for example.

Finally the signal synthesis unit 13 synthesizes the modified vocal tract characteristic $sp_2$ and the vocal source signal $r_1$ to generate and output an output voice, s, such as an output voice, s, with formant emphasis.

Figure 19:
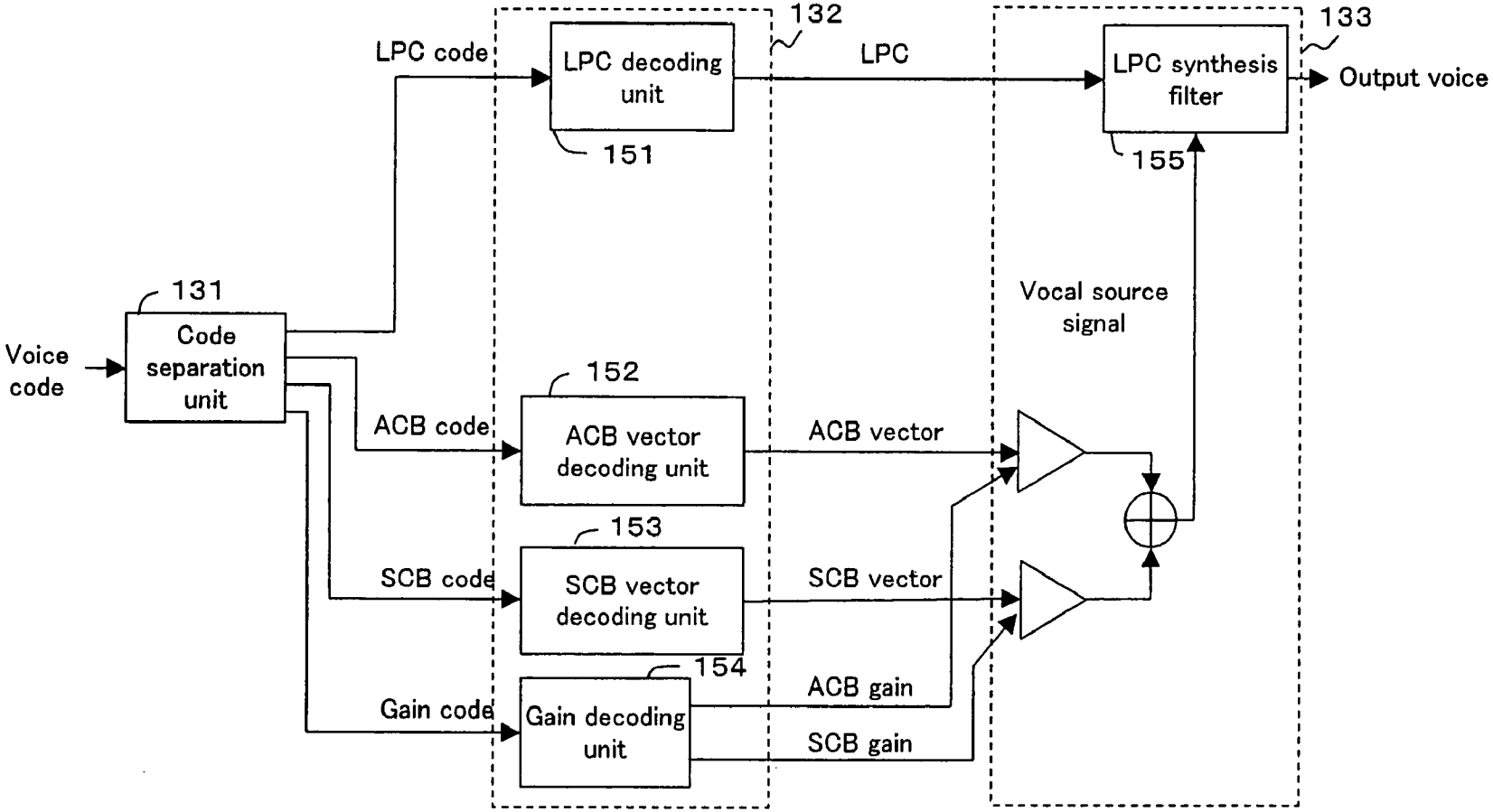
FIG. 19 shows a block diagram of the architecture of a CELP decoder.
Figure 20:
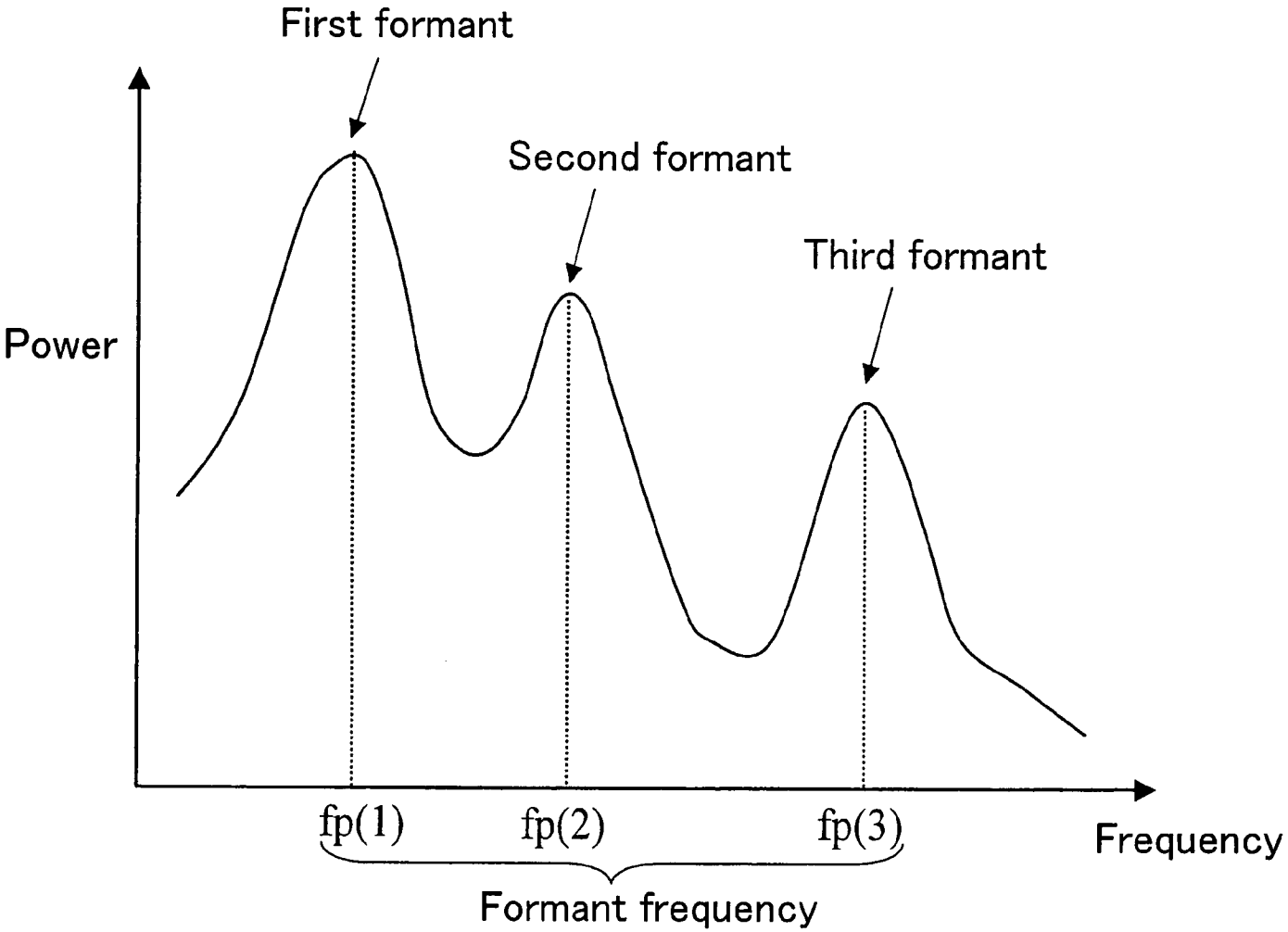
FIG. 20 exemplifies a voice spectrum.
Figure 21:
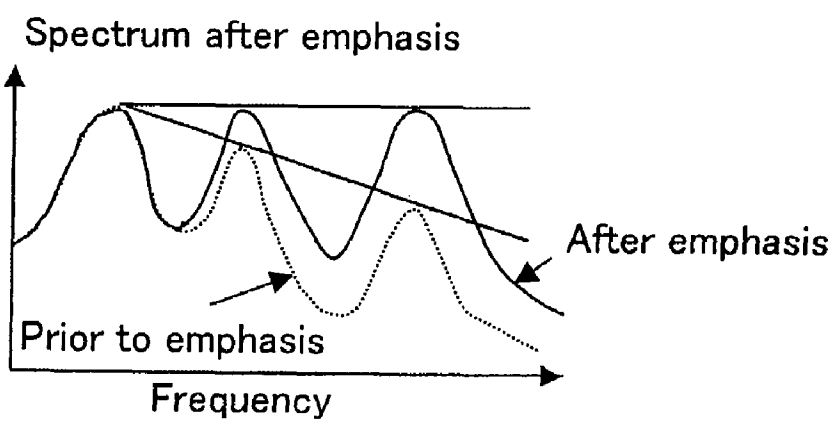
FIG. 21 exemplifies formant emphasis of a voice spectrum.
Figure 21:
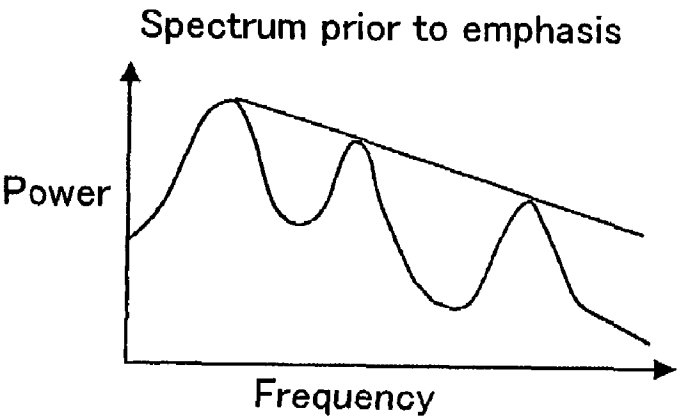
Figure 22:
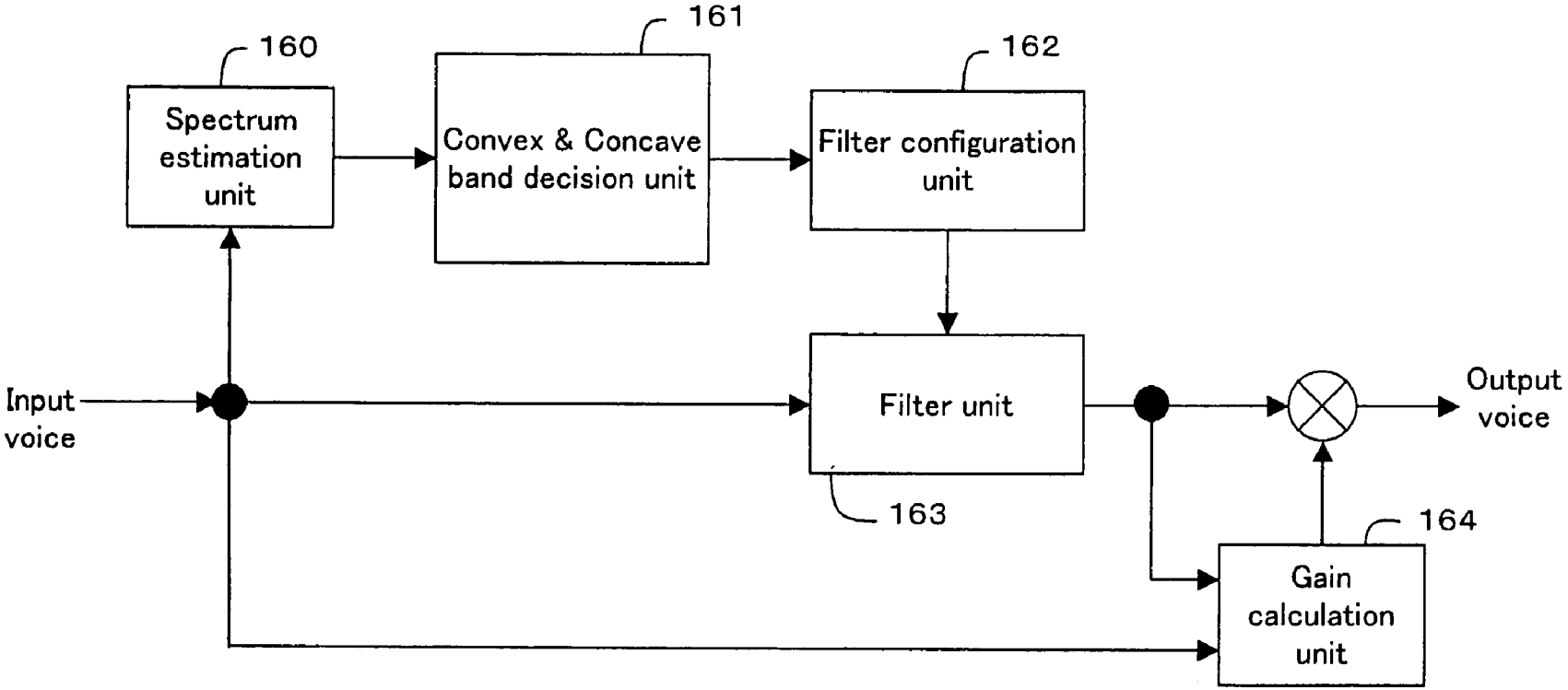
FIG. 22 shows the basic configuration of the invention noted by the patent document 1.

As described above, in the patent document 1, such as FIG. 19 therein, a synthesized signal (i.e., synthesized voice) is generated by filtering a restored vocal source signal (i.e., output by the adder) bypassing it through a synthesis filter configured by a decoded LPC, and the synthesized voice is emphasized by an emphasis filter determined by a vocal tract characteristic. Therefore, the distortion of the vocal source signal contained in the synthesized voice increases, sometimes creating problems such as an increased sense of noisiness and a degradation of clarity.

Contrary to the above, the speech decoder 10 according to the present embodiment, though the processing from the beginning until restoring a vocal source signal and LPC is approximately the same as above, in contrast applies formant emphasis processing directly to the vocal tract characteristic $sp_1$ and synthesizes the emphasized vocal tract characteristic $sp_2$ and the vocal source signal (i.e., residual differential signal), without generating synthesized signal (synthesized voice). Therefore, the above described problem is solved, making it possible to achieve a decoded voice without causing side effects such as degraded voice quality by emphasis or an increased sense of noisiness.

Figure 2:
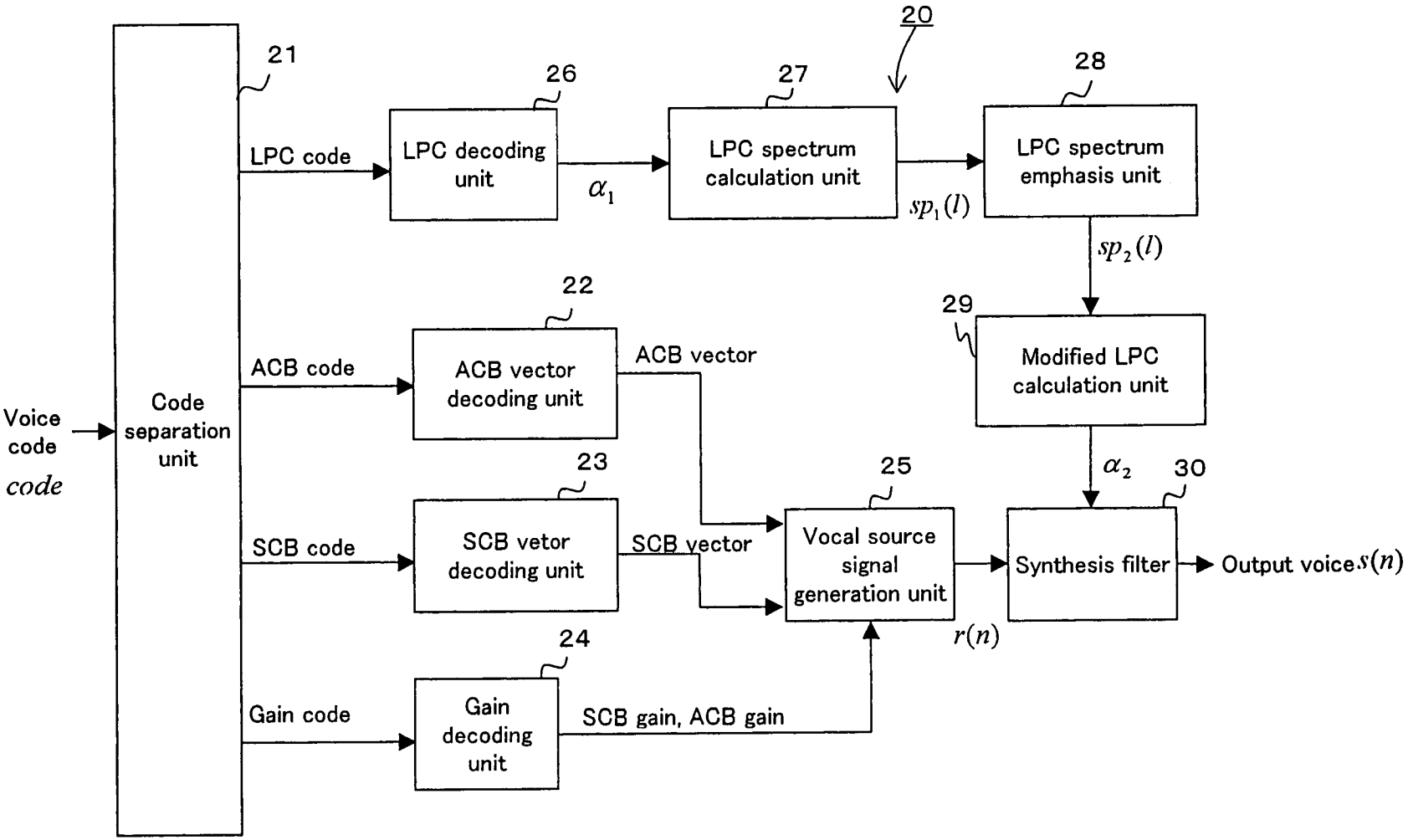
FIG. 2 shows the basic configuration of a speech decoder of the present embodiment.

FIG. 2 shows the basic configuration of a speech decoder of the present embodiment.

Note that the CELP (Code Excited Linear Prediction) method is used for a voice coding method in the following description, but it is not limited as such and, rather, any voice coding method of an analysis-synthesis system may be applied.

A speech decoder 20 shown by FIG. 2 comprises a code separation unit 21, an ACB vector decoding unit 22, an SCB vector decoding unit 23, a gain decoding unit 24, a vocal source signal generation unit 25, an LPC decoding unit 26, an LPC spectrum calculation unit 27, a spectrum emphasis unit 28, a modified LPC calculation unit 29 and a synthesis filter 30.

Incidentally, the code separation unit 21, LPC decoding unit 26, ACB vector decoding unit 22, SCB vector decoding unit 23 and gain decoding unit 24 correspond to an example of a detailed configuration of the above described code separation/decoding unit 11. The spectrum emphasis unit 28 is an example of the above described vocal tract characteristic modification unit 12. The modified LPC calculation unit 29 and synthesis filter 30 correspond to an example of the above described signal synthesis unit 13.

The code separation unit 21 outputs an LPC, ACB, SCB and gain codes by separating them from the voice code code transmitted from the transmitter following multiplexing thereby.

The ACB vector decoding unit 22, SCB vector decoding unit 23 and gain decoding unit 24 respectively decode the ACB, SCB and gain codes output by the above described code separation unit 21 to gain the ACB vector, SCB vector, and the ACB and SCB gains, respectively.

The vocal source signal generation unit 25 generates vocal source signals (i.e., residual differential signal) r(n), where $0 \leqq n \leqq N$, and N is a frame length in the coding method based on the above described ACB vector, SCB vector and the ACB and the SCB gains.

Meanwhile, the LPC decoding unit 26 decodes the LPC code output by the above described code separation unit 21 to gain LPC $\alpha_1(i)$, where $1 \leqq i \leqq NP_1$, and outputs them to the LPC spectrum calculation unit 27, where $NP_1$ is the order of the LPC.

The LPC spectrum calculation unit 27 calculates LPC spectra $sp_1(l)$, where $0 \leqq l \leqq N_F$, which is a parameter expressing a vocal tract characteristics from the input LPC $\alpha_1(i)$. Note that $N_F$ is a spectrum mark that satisfies $N \leqq N_F$. The LPC spectrum calculation unit 27 outputs the calculated LPC spectrum $sp_1(l)$ to the spectrum emphasis unit 28.

The spectrum emphasis unit 28 calculates the emphasized LPC spectra $sp_2(l)$ based on the LPC spectra $sp_1(l)$ to output to the modified LPC calculation unit 29.

The modified LPC calculation unit 29 calculates the modified LPC $\alpha_2(i)$, where $1 \leqq i \leqq NP_2$, based on the emphasized LPC spectra $sp_2(l)$. Here, $NP_2$ is the order of the modified LPC. The modified LPC calculation unit 29 outputs the calculated modified LPC $\alpha_2$ to the synthesis filter 30.

Then, inputs the above described vocal source signals r(n) into the synthesis filter 30 configured by the calculated modified LPC $\alpha_2(i)$ to obtain the output voice s(n), where $0 \leqq n \leqq N$. This makes it possible to achieve a clearer voice through the emphasized formants.

As described above, the present embodiment applies a formant emphasis directly to the vocal tract characteristic (i.e., LPC spectrum calculated from the LPC) calculated from the voice code for emphasizing the vocal tract characteristic, followed by synthesis with the vocal source signal, making it possible avoid the problems of the conventional technique, that is, "a distortion of vocal source signal caused by an emphasis by using the emphasis filter obtained from the vocal tract characteristic."

Figure 3:
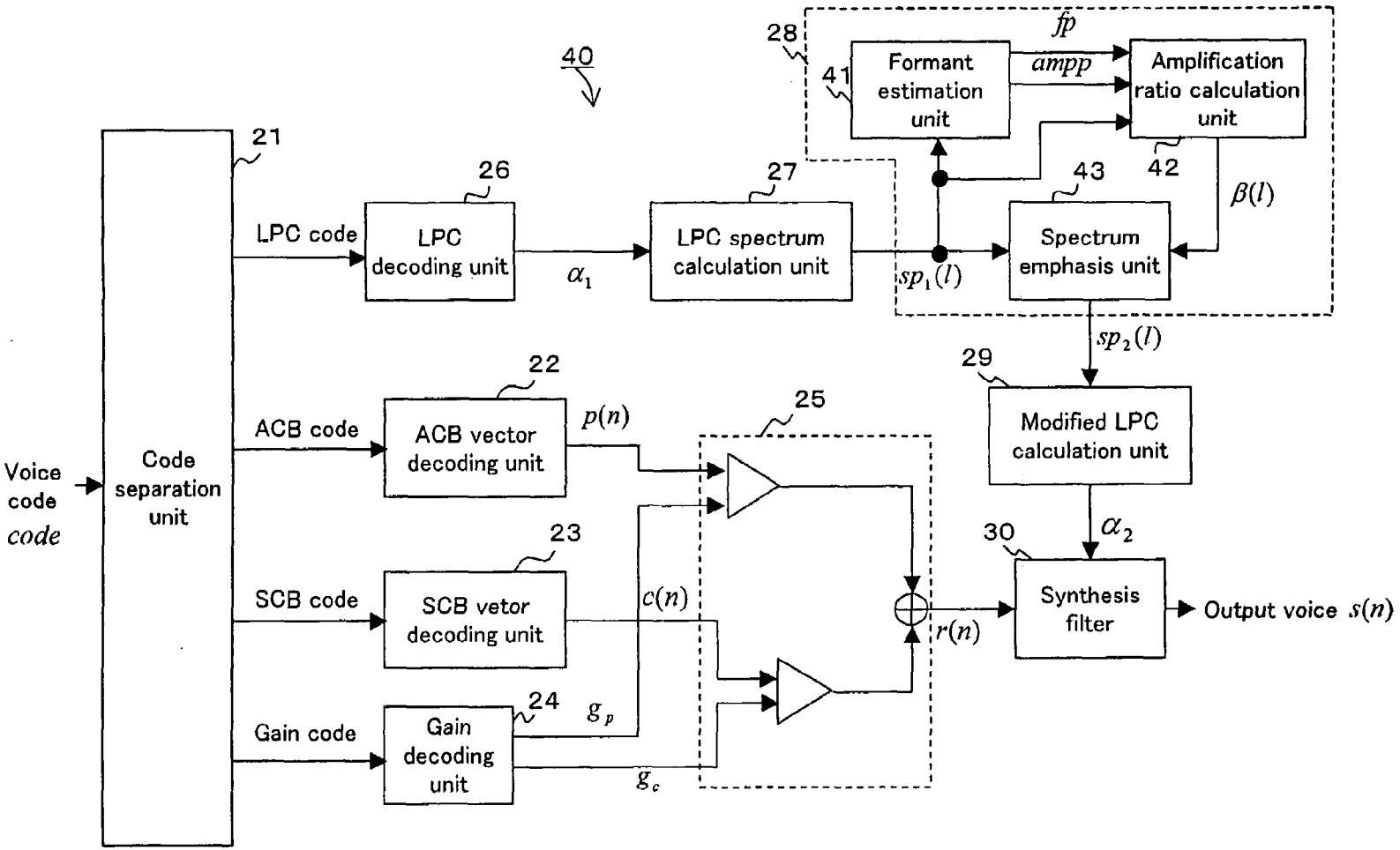
FIG. 3 shows a structural block diagram of speech decoder 40 according to a first embodiment.

FIG. 3 shows a structural block diagram of a speech decoder 40 according to a first embodiment.

In FIG. 3, components that are approximately the same in configuration as those of the speech decoder 20 shown by FIG. 2 are assigned the same component numbers.

Note that the CELP method is used for the voice coding method in the present embodiment, but it is not limited as such and, rather, any voice coding method in the analysis-synthesis system may be applied.

First, the code separation unit 21 separates the voice code code into LPC, ACB, SCB codes and a gain code.

The ACB vector decoding unit 22 decodes the above noted ACB code to obtain the ACB vectors p(n), where $0 \leqq n \leqq N$, and N is the frame length of the coding method. The SCB vector decoding unit 23 decodes the above noted SCB code to obtain the SCB vectors c(n), where $0 \leqq n \leqq N$. The gain decoding unit 24 decodes the above noted gain code to obtain the ACB gain $g_p$ and the SCB gain $g_c$.

The vocal source signal generation unit 25 calculates the vocal source signals r(n), where $0 \leqq n \leqq N$, by using the above noted decoded ACB vectors p(n), SCB vectors c(n), ACB gain $g_p$ and SCB gain $g_c$ according to the following equation (1):

$$r(n)=g_p p(n)+g_c c(n) \quad (0 \leqq n < N) \qquad \text{Equation (1)}$$

Meanwhile, the LPC decoding unit 26 decodes the LPC separated by and output by the above described code separation unit 21 to obtain the LPC $\alpha_1(i)$, where $1 \leqq i \leqq NP_1$, and $NP_1$ denotes the order of LPC, and sends it to the LPC spectrum calculation unit 27.

The LPC spectrum calculation unit 27 obtains the LPC spectra $sp_1(l)$ as the vocal tract characteristic by calculating the Fourier transformation of the LPC $\alpha_1(i)$ by the following equation (2), where $N_F$ is the number of data points for the spectra; and $P_1$ is the order of the LPC filter. Letting the sampling frequency be $F_s$, the frequency resolution of the LPC spectrum $sp_1(l)$ is $F_s/N_F$. The variable, l, is the index of spectrum, indicating a discrete frequency. The variable l is converted to a frequency, by the equation int[$l*F_s/N_F$] (Hz), where the int[x] denotes the conversion of variable x to an integer.

$$sp_1(l) = \left| \frac{1}{1 + \sum_{i=1}^{P_1} \alpha_1(i) \cdot \exp(-j2\pi il/N_F)} \right|^2, \quad (0 \le l < N_F) \qquad \text{Equation (2)}$$

The LPC spectrum $sp_1(l)$ obtained by the LPC spectrum calculation unit 27 is input to a formant estimation unit 41, an amplification ratio calculation unit 42 and a spectrum emphasis unit 43.

First, the formant estimation unit 41, receiving input of the LPC spectrum $sp_1(l)$, estimates the formant frequencies fp(k), where $1 \leqq k \leqq kmax$, and the amplitudes ampp(k), where $1 \leqq k \leqq kpmax$. Here, kpmax is the number of formants to be estimated. While the value of kpmax is discretionary, a value of kpmax=4 or 5 for example is appropriate for a voice sampled at 8 (kHz).

While an estimation method for the above described formant frequency is discretionary, an example technique may be of a known technique such as the peak picking method for estimating a formant based on peaks of the frequency spectrum.

Let the obtained formant frequencies be defined as fp(1), fp(2), . . . fp(kpmax) from the low to high frequencies; and the amplitude value at fp(k) as ampp(k).

Incidentally, a threshold value may be provided for the bandwidth of a formant so as to define frequencies with the bandwidth being no more than the threshold value formant frequencies.

The amplification ratio calculation unit 42 calculates an amplification factor $\beta(l)$ for the LPC spectra $sp_1(l)$ by input of the above described LPC spectra $sp_1(l)$ and the formant frequencies and amplitudes, {fp(k), ampp(k)}, estimated by the formant estimation unit 41.

Figure 4:
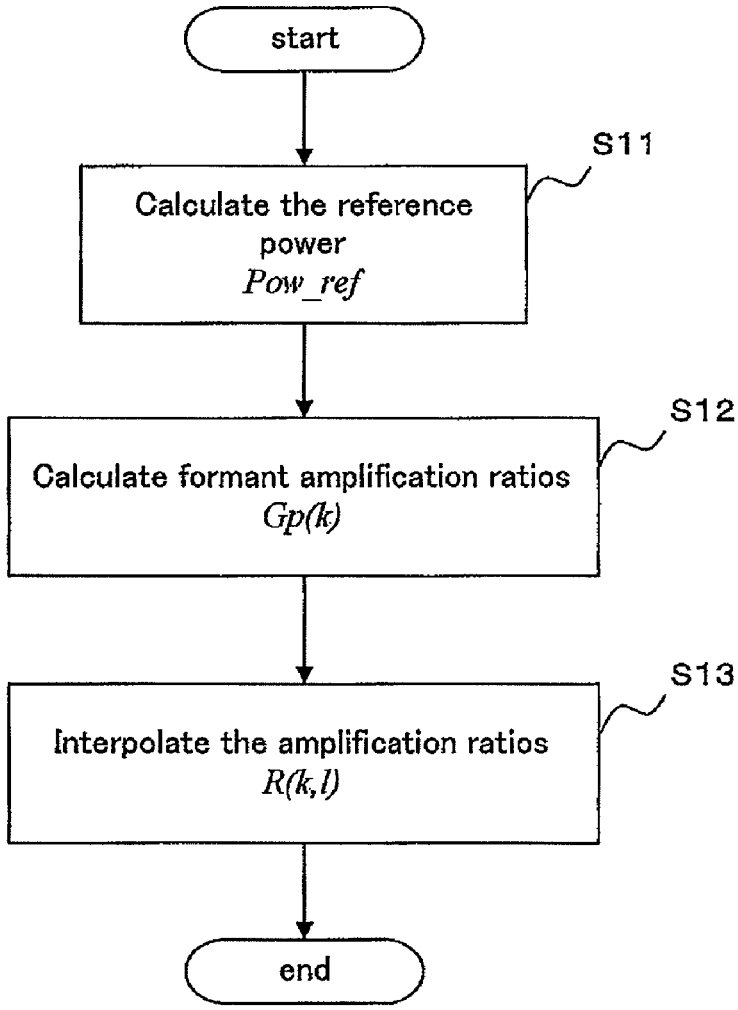
FIG. 4 shows a process flow chart of an amplification ratio calculation unit.

FIG. 4 shows a process flow chart for an amplification ratio calculation unit 42.

As shown by FIG. 4, the processes in the amplification ratio calculation unit 42 are, sequentially, a calculation of the reference power for amplification (step S11; simply noted "S11" hereinafter), a calculation of the amplification ratio of a formant (S12) and an interpolation of an amplification ratio (S13).

The first description is of the processing of step S11, that is, for calculating the reference power for amplification, Pow_ref, based on the LPC spectrum $sp_1(l)$.

The calculation method for the reference power for amplification, Pow_ref, is discretionary. There are, for example, a method for taking the average power of the entire frequency band, a method for taking the maximum amplitude from among the formant amplitudes amp(k), where $1 \leqq k \leqq kpmax$, as the reference power, et cetera. Alternatively, the reference power may be obtained as a function whose variable is frequency or formant order. In the case of taking the average power of the entire frequency band as the reference power, the reference power for amplification, Pow_ref, is expressed by the following equation (3).

$$\text{Pow_ref} = \frac{1}{N_F}\sum_{l=0}^{N_F-1} sp_1(l) \qquad \text{Equation (3)}$$

Figure 5:
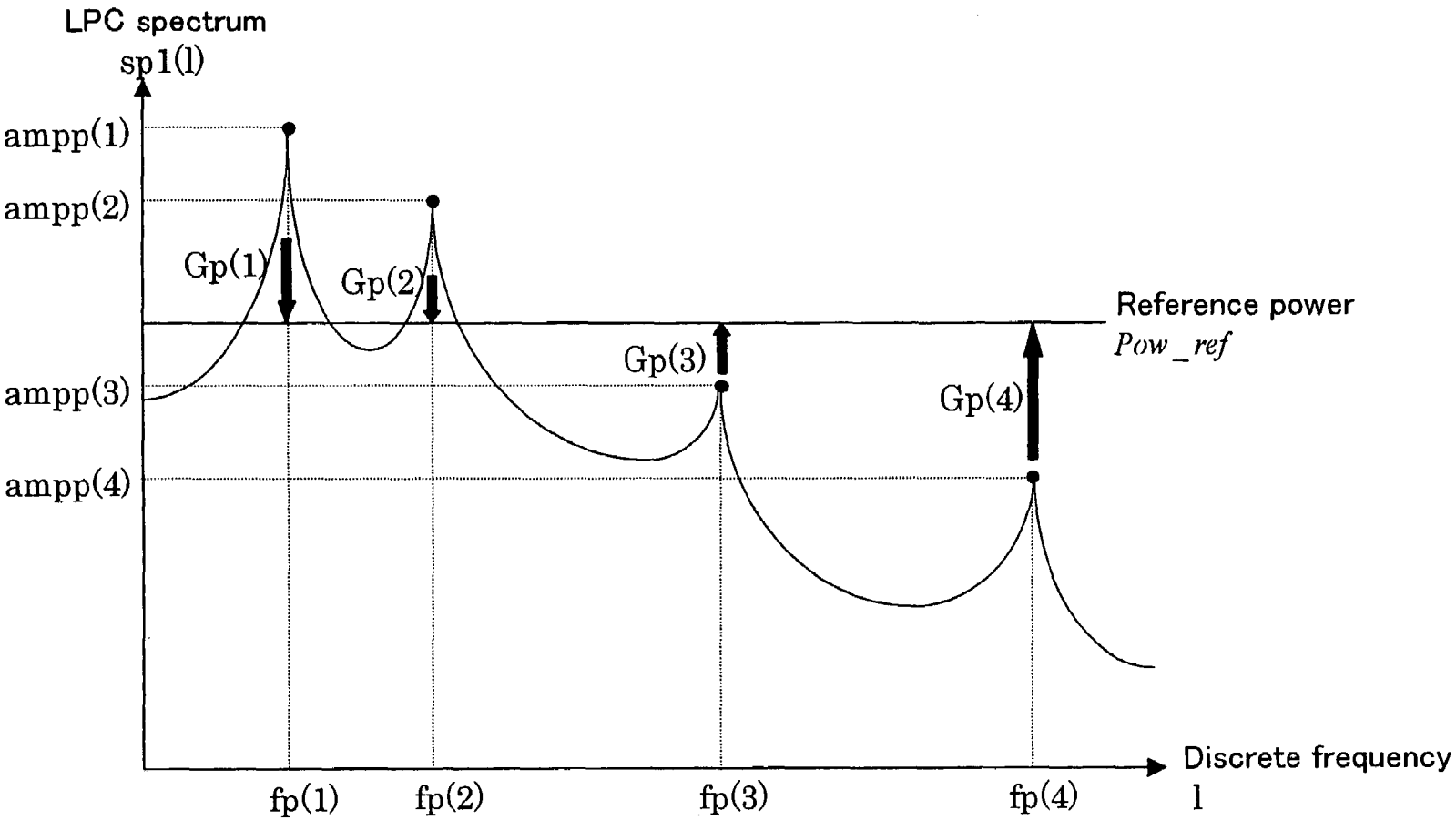
FIG. 5 shows how an amplification ratio of a formant is calculated.

The S12, determines formant amplification ratios Gp(k) so as to result in the formant amplitudes ampp(k), where 1≦k≦kpmax, match with the amplification reference power, Pow_ref, obtained in S11. FIG. 5 shows how the formant amplitudes ampp(k) are matched with the amplification reference power, Pow_ref. Emphasizing the LPC spectrum by using the amplification ratios obtained as described above flattens the inclination of the entire spectrum, thereby improving the clarity of the voice across the whole spectrum.

The following equation (4) is for calculating amplification ratios Gp(k).

$$Gp(k)=\text{Pow_ref}/\text{ampp}(k)(1\leqq k\leqq kp_{max}) \qquad \text{Equation (4)}$$

Further, the S13, calculates an amplification ratio β(l) of the frequency band existing between the adjacent formants (i.e., between fp(k) and fp(k+1)) by an interpolation curve R(k,l). While the form of the interpolation curve is discretionary, the following exemplifies the case of a quadratic interpolation curve R(k,l).

Figure 6:
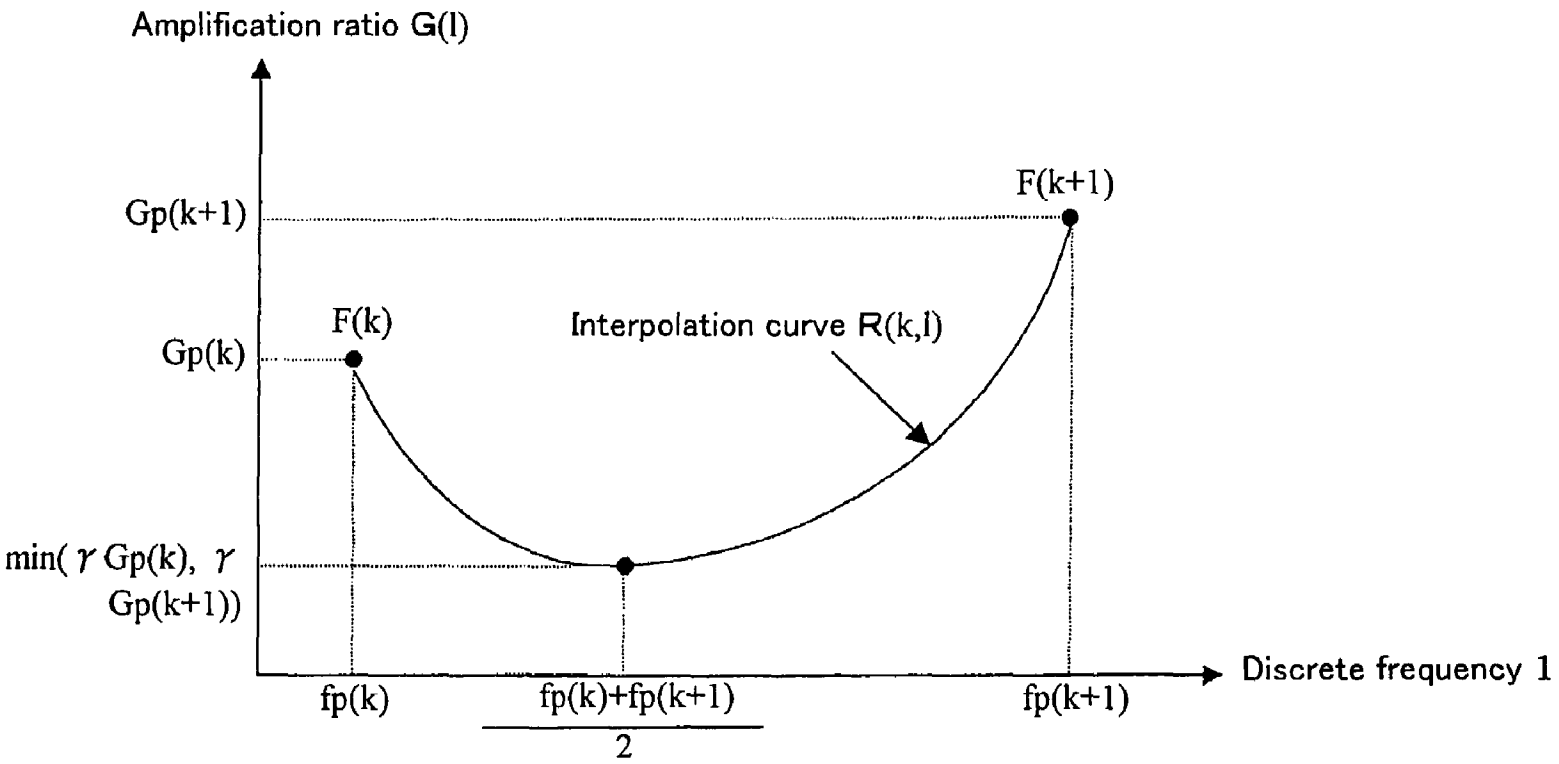
FIG. 6 exemplifies an interpolation curve.

First, defining an interpolation curve R(k,l) as a discretionary quadratic curve the curve R(k,l) is expressed by the following equation (5).

$$R(k,l)=al^2+bl+c \qquad \text{Equation (5);}$$

where a, b, and c are discretionary. Let it be defined that the interpolation curve R(k,l) goes through {fp(k),Gp(k)}, {fp(k+1),Gp(k+1)} and {(fp(k)+fp(k+1))/2, min(γGp(k), γGp(k+1))} as shown by FIG. 6, where min(x,y) is a function the result of which is minimum of x and y, and γ is a discretionary constant satisfying 0≦γ≦1.

Substituting these into the equation (5) leads to:

$$Gp(k)=a\cdot fp(k)^2+b\cdot fp(k)+c \qquad \text{Equation (6);}$$

$$Gp(k+1)=a\cdot fp(k+1)^2+b\cdot fp(k+1)+c \qquad \text{Equation (7); and}$$

$$\min(\gamma Gp(k),\ \gamma Gp(k+1)) = a\cdot\left(\frac{fp(k)+fp(k+1)}{2}\right)^2 + b\cdot\left(\frac{fp(k)+fp(k+1)}{2}\right) + c \qquad \text{Equation (8)}$$

Obtaining a, b and c by solving the simultaneous equations (6), (7) and (8) will result in an interpolation curve R(k,l). Then interpolates the amplification ratio β(l) by obtaining an amplification ratio for the spectrum of period [fp(k), fp(k+1)] based on the interpolation curve R(k,l).

The processes of the above described steps S11 through S13 are executed for all the formants to determine the amplification ratios for the entire frequency band. Note that the amplification ratio for frequencies lower than the formant of the lowest order fp(1) is Gp(1) of the fp(1) and the amplification ratio for frequencies higher than the formant of the highest order Gp(kpmax) is the amplification ratio Gp(kpmax) of the fp(kpmax) Summarizing the above, the amplification ratio β(l) is given by the following equation (9):

$$\beta(l) = \begin{cases} Gp(1), & (l < fp(1)) \\ R_i(k,l), & (fp(1) \le l \le fp(kp_{max}),\ i = 1, 2) \\ Gp(kp_{max}), & (fp(kp_{max}) < l) \end{cases} \qquad \text{Equation (9)}$$

Incidentally in the above equation (9), the reason for Ri(k,l) and i=1, 2 is for the case corresponding to a later described second embodiment, whereas Ri(k,l) is replaced by R(k,l) and i=1, 2 are accordingly deleted for the first embodiment.

The amplification ratio β(l) obtained by the amplification ratio calculation unit 42 through the above described processes and the above described LPC spectra $sp_1(l)$ are now input to the spectrum emphasis unit 43 which in turn calculates an emphasized spectrum $sp_2(l)$ according to the following equation (10):

$$sp_2(l)=\beta(l)\cdot sp_1(l),(0\leqq l<N_F) \qquad \text{Equation (10)}$$

The emphasized spectrum $sp_2(l)$ obtained by the spectrum emphasis unit 43 is then input to the modified LPC calculation unit 29 which in turn calculates auto-correlation functions $ac_2(i)$ by applying an inverse Fourier transformation to the emphasized spectra $sp_2(l)$, followed by obtaining a modified LPC $\beta_2(i)$, where $1\leqq i\leqq NP_2$ from the auto-correlation functions $ac_2(i)$ by using a known method such as the Levinson algorithm, where the $NP_2$ is the order of the modified LPC.

Then inputs the above described vocal source signal r(n) into the synthesis filter 30 configured by the modified LPC $\alpha_2(i)$ obtained by the above described modified LPC calculation unit 29.

The synthesis filter 30 calculates an output voice s(n) by the following equation (11), by which the emphasized vocal tract characteristic and the vocal source characteristic are synthesized.

$$s(n) = r(n) - \sum_{i=1}^{p_2} \alpha_2(i)s(n-i), \quad (0 \le n < N) \qquad \text{Equation (11)}$$

As described above, a vocal tract characteristic decoded from a voice code is emphasized, followed by synthesizing it with a vocal source signal in the first embodiment. This suppresses the spectral distortion occurring when emphasizing the vocal tract characteristic and the vocal source signal simultaneously, as has been a problem with the conventional technique, thereby improving voice clarity. Furthermore, the present embodiment calculates amplification ratios for frequency components other than formants based on the amplification ratios for the formants and thereby applies the emphasis processing therefor, hence emphasizing the vocal tract characteristic smoothly.

Note that while the present embodiment calculates an amplification ratio for the spectra $sp_1(l)$ in units of spectrum marks, the spectrum may be divided into a plurality of frequency bands so as to obtain the respective amplification ratios for those frequency bands.

Figure 7:
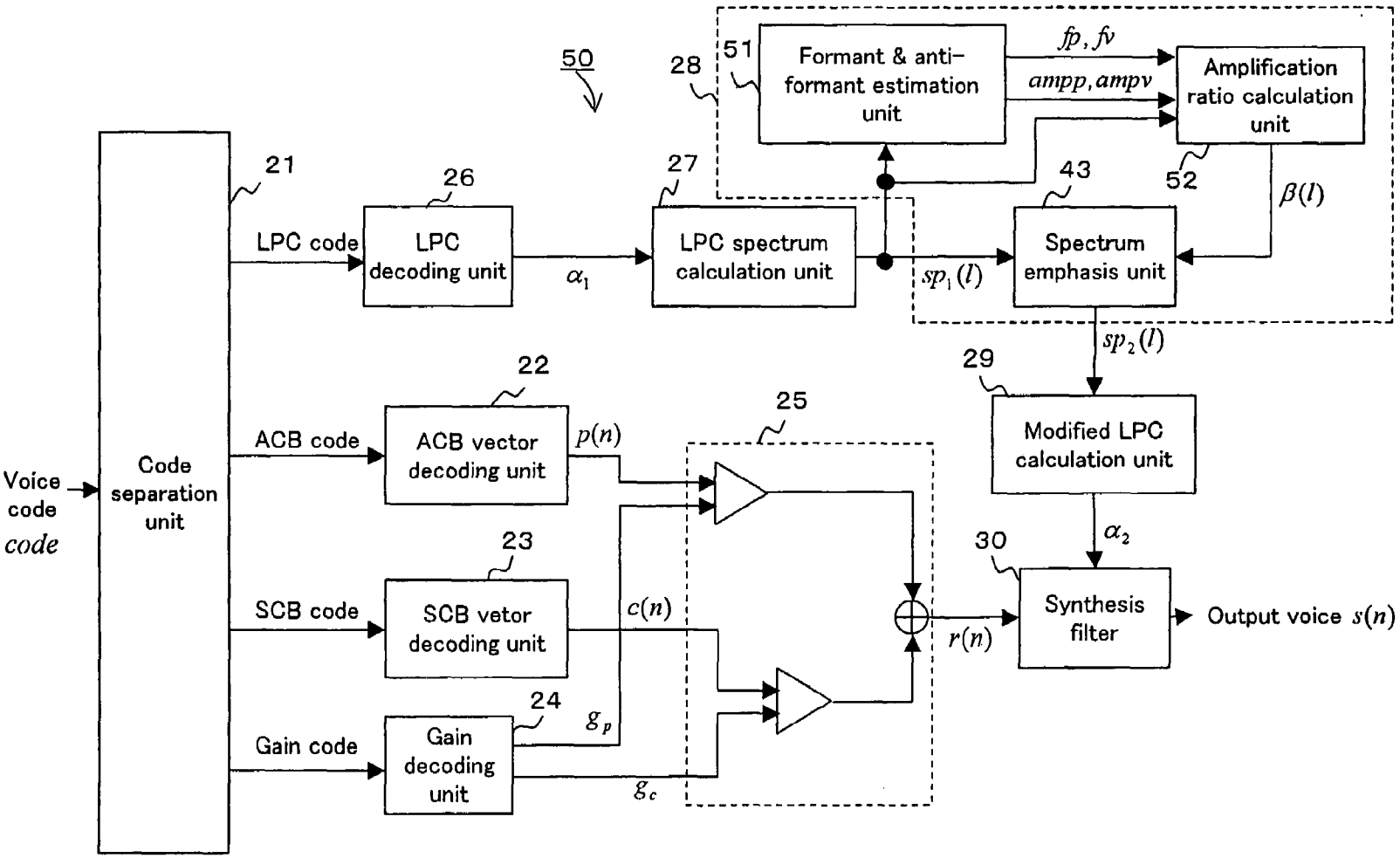
FIG. 7 shows a structural block diagram of a speech decoder according to a second embodiment.

FIG. 7 shows a structural block diagram of a speech decoder 50 according to a second embodiment.

In the configuration shown by FIG. 7, components that are approximately the same as those of the speech decoder 40 shown by FIG. 3 are assigned the same component numbers, and the details different from the first embodiment are described in the following.

The second embodiment is characterized by attenuating anti-formants whose amplitudes take minimum values, in addition to emphasizing formants to emphasize the difference between formants and anti-formants. Note that the present embodiment assumes that an anti-formant only exists between two adjacent formants in the following description, but it is not limited as such and rather it is possible to apply the present embodiment to the case where an anti-formant exists in a lower frequency than the lowest order formant or in a higher frequency than the highest order formant.

A speech decoder 50 shown by FIG. 7 comprises a formant/anti-formant estimation unit 51 and an amplification ratio calculation unit 52, which together replace the formant estimation unit 41 and amplification ratio calculation unit 42 comprised by the speech decoder 40 shown by FIG. 3, while the other components are approximately the same as the speech decoder 40.

The formant/anti-formant estimation unit 51, having received an LPC spectra $sp_1(l)$, estimates anti-formant frequencies fv(k), where $1 \leqq k \leqq kvmax$, and the amplitudes ampv(k), where $1 \leqq k \leqq kvmax$, in addition to formant frequencies fp(k), where $1 \leqq k \leqq kpmax$, and the amplitudes ampp(k), where $1 \leqq k \leqq kpmax$, the same as the above described formant estimation unit 41. While the method for estimating the anti-formant is discretionary, an example method is to apply the peak picking method to the inverse number of spectra $sp_1(l)$, where the obtained anti-formants are defined sequentially from the lower order, as, fv(1), fv(2), . . . fv(kvmax), kvmax is the number of anti-formants and ampv(k) is the amplitude at fv(k).

The estimation result of the formants and anti-formants obtained by the formant/anti-formant estimation unit 51 is then input to the amplification ratio calculation unit 52.

Figure 8:
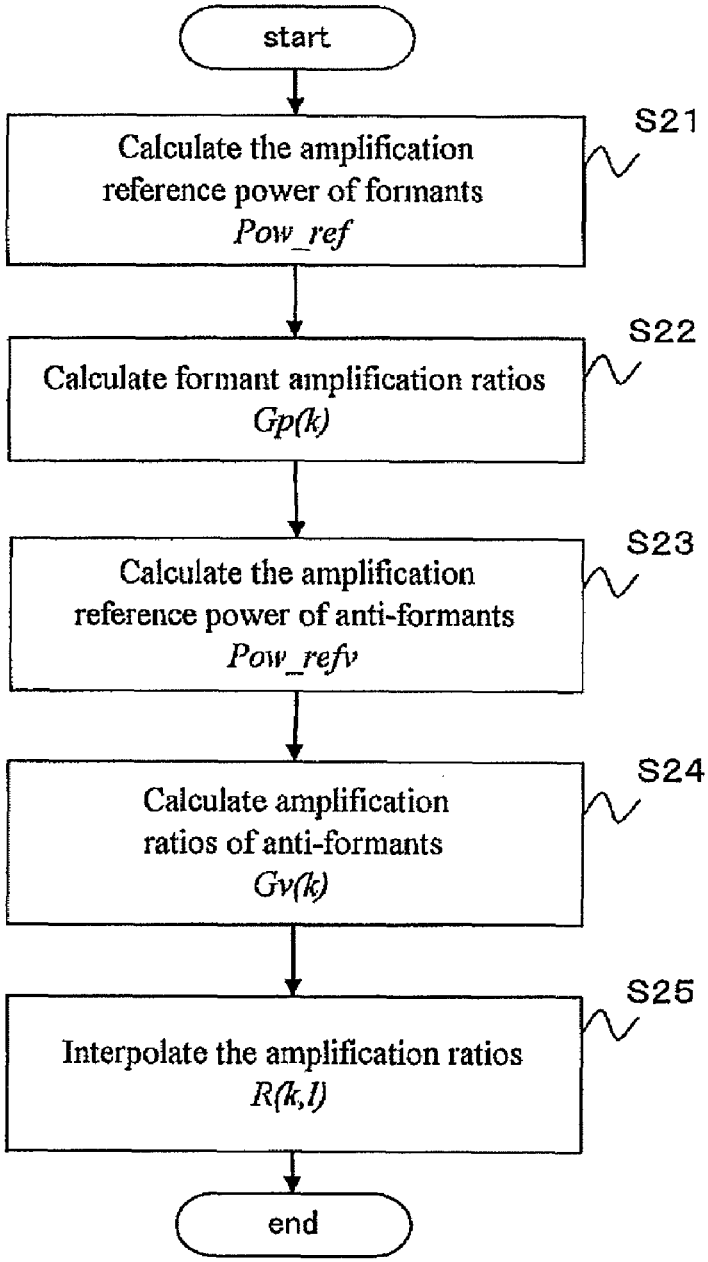
FIG. 8 shows a process flow chart for an amplification ratio calculation unit.

FIG. 8 shows a process flow chart for the amplification factor calculation unit 52.

The processes of the amplification factor calculation unit 52 are performed in the order of calculating the reference power of formants for amplification (S21), determining amplification ratios of formants (S22), calculating the amplification reference power of anti-formants (S23), determining amplification ratios of anti-formants (S24) and interpolating amplification ratios (S25) as shown by FIG. 8. The processings of S21 and S22 are the same as of the steps S11 and S12, respectively, and therefore the descriptions thereof are omitted herein.

The following description is of the step S23 and steps thereafter.

The first description is of a calculation of amplification reference powers of anti-formants in the step S23.

The amplification reference power of anti-formant Pow_refv is calculated from the LPC spectra $sp_1(l)$ The method being discretionary, there are examples of methods using the amplification reference power of formant Pow_ref multiplied by a constant less than one (1) and choosing the minimum amplitude as the reference power from among the anti-formant amplitudes ampv(k), where $1 \leqq k \leqq kvmax$.

The following equation (12) is used when the amplification reference power of formant Pow_ref multiplied by a constant is chosen as the reference power of the anti-formant:

$$\text{Pow_refv} = \lambda \text{Pow_ref} \qquad \text{Equation (12);}$$

where $\lambda$ is a discretionary constant satisfying $0 < \lambda < 1$.

The next description is of the processing of the determination of the amplification ratios of anti-formants in the step S24.

Figure 9:
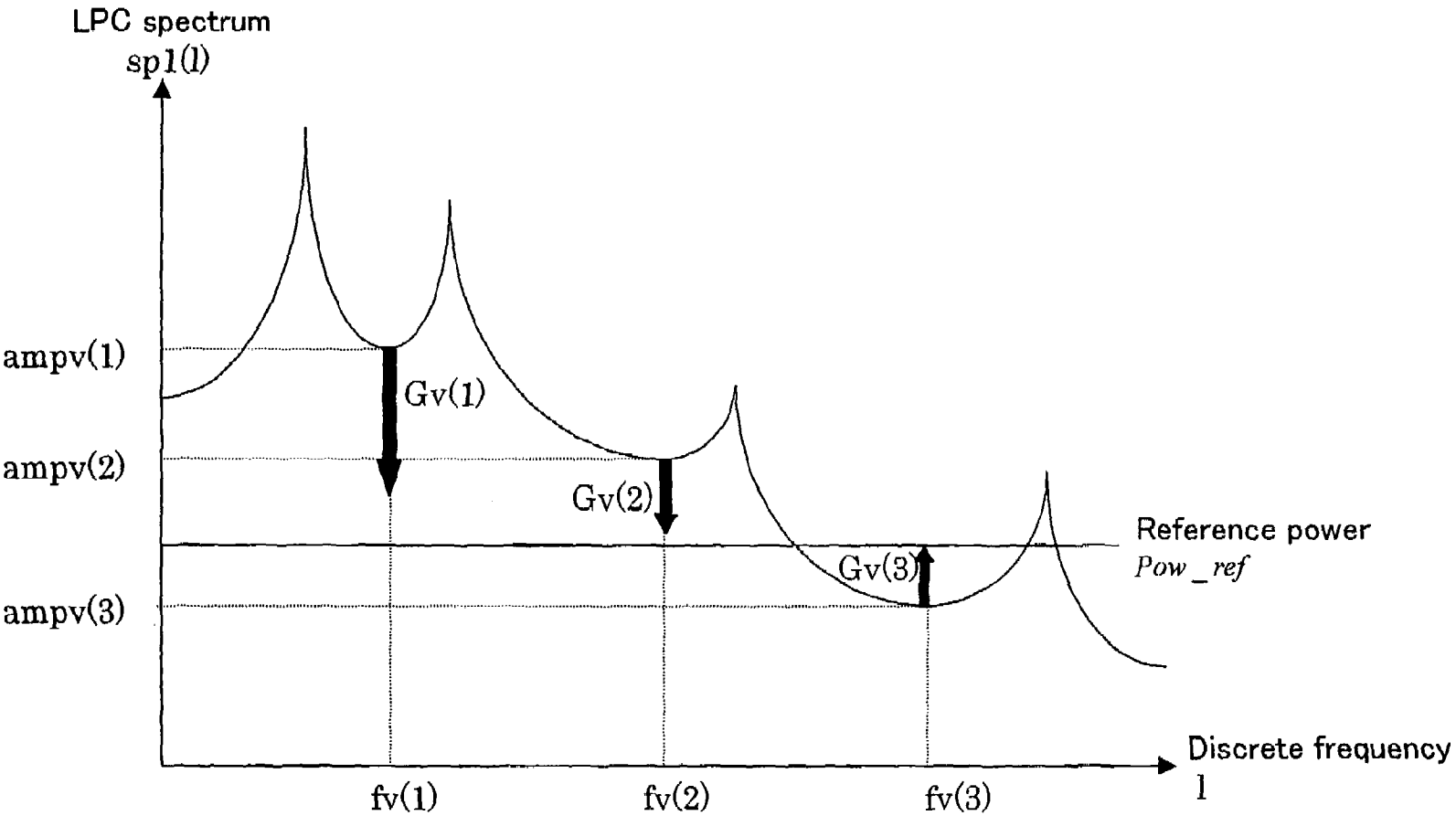
FIG. 9 shows how amplification ratios of anti-formants are determined.

FIG. 9 shows how amplification ratios of anti-formants Gv(k) are determined. As understood by FIG. 9, step S24 determines the amplification ratios Gv(k) so as to match the anti-formant amplitudes ampv(k), where $1 \leqq k \leqq kvmax$, with the amplification reference power of anti-formant Pow_refv obtained by the step S23.

The following equation (13) is for calculating amplification ratios of anti-formants Gv(k):

$$Gv(k) = \text{Pow_refv}/\text{ampv}(k)(0 \leqq k \leqq kv_{max}) \qquad \text{Equation (13)}$$

Finally step S25, performs the interpolation processing for the amplification ratios.

The processing is to obtain the amplification ratio for the frequencies between adjacent formant frequencies and anti-formant frequencies by the interpolation curves Ri(k,l), where i=1, 2; an interpolation curve $R_1(k,l)$ is for the interval [fp(k),fv(k)] and an interpolation curve $R_2(k,l)$ is for the interval [fv(k),fp(k+1)].

The method for obtaining the interpolation curve is discretionary.

The following exemplifies a calculation of a quadratic interpolation curve Ri(k,l).

Letting a form of quadratic curve be defined to pass through {fp(k),Gp(k)} and reach a minimum value at {fv(k), Gv(k)} the quadratic curve is expressed by the following equation (14):

$$\beta(l) = a\{l - fv(k)\}^2 + Gv(k) \qquad \text{Equation (14);}$$

where "a" is a discretionary constant satisfying 0<a. Since the equation (14) passes through {fp (k), Gp (k)}, rearranging it by substituting {l, β(l) }={fp(k),Gp(k)} results in the following equation (15) for "a":

$$a = \frac{Gp(k) - Gv(k)}{\{fp(k) - fv(k)\}^2} \qquad \text{Equation (15)}$$

The equation (15) makes it possible to calculate the "a", and obtain the quadratic curve $R_1(k,l)$ and the interpolation curve $R_2(k,l)$ between fv(k) and fp(k+1).

Summarizing the above, the amplification ratios β(l) are expressed by the above described equation (9).

The amplification ratio calculation unit 52 outputs the amplification ratios β(l) to the spectrum emphasis unit 43 which in turn calculates an emphasized spectra $sp_2(l)$ according to the above described equation (10) by using the amplification ratios β(l).

As described thus far, the second embodiment attenuates anti-formants in addition to amplifying formants, thereby further emphasizing the formants relative to the anti-formants and further improving the clarity as compared to the first embodiment.

Also, attenuating anti-formants makes it possible to suppress a sense of noisiness prone to accompany a decoded voice after voice coding processing. A voice coded and decoded by a voice coding method such as the CELP which is used for a mobile phone, et cetera, is known to be accompanied by a noise called quantization noise in the anti-formants. The present invention attenuates the anti-formants, thereby reducing the quantization noise and providing a voice that is easy to hear with little sense of noisiness.

Figure 10:
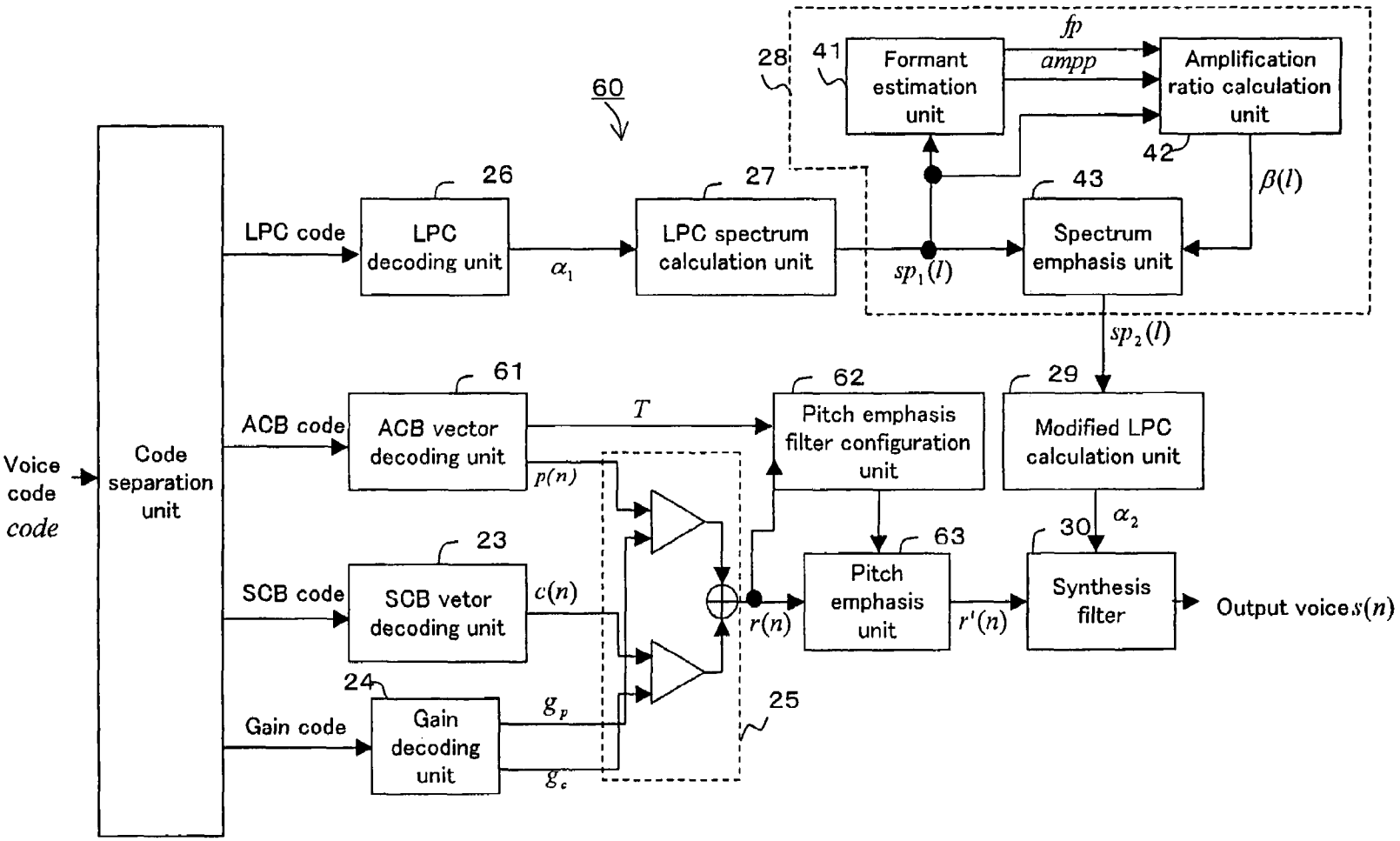
FIG. 10 shows a structural block diagram of speech decoder according to a third embodiment.

FIG. 10 shows a structural block diagram of a speech decoder 60 according to a third embodiment.

In the configuration shown by FIG. 10, components that are approximately the same as those of the speech decoder 3 shown by FIG. 40 are assigned the same component numbers, and the following description is of the parts different from those of the first embodiment.

The third embodiment is characterized by a configuration for applying a pitch emphasis on a vocal source signal in addition to that of the first embodiment, that is, by comprising a pitch emphasis filter configuration unit 62 and a pitch emphasis unit 63. Furthermore, an ACB vector decoding unit 61 not only decodes the ACB code to obtain ACB vectors p(n), where $0 \leqq n \leqq N$, but also obtain the integer part T of pitch lag from the ACB code to output to the pitch emphasis filter configuration unit 62.

While the method for a pitch emphasis is discretionary, there is for example the following method.

First, the pitch emphasis filter configuration unit 62 calculates auto-correlation functions rscor(T−1), rscor(T) and rscor(T+1) for T and pitches in the proximity of T by the following equation (16) by using the integer part of the pitch lag output by the above described ACB vector decoding unit 61:

$$rscor(i) = \sum_{n=i}^{N-1} r(n) \cdot r(n-i), \quad (i = T-1, T, T+1) \qquad \text{Equation (16)}$$

The pitch emphasis filter configuration unit 62 then calculates pitch predictor coefficients pc(i), where i=−1,0,1, from the above described auto-correlation functions rscor(T−1), rscor(T) and rscor(T+1) by a known method such as the Levinson algorithm.

The pitch emphasis unit 63 filters a vocal source signal r(n) by subjecting it to a pitch emphasis filter (i.e., a filter with the transfer function described by equation (17); $g_p$ as a weighting factor) configured by the pitch predictor coefficients pc(i) to output a residual differential signal (i.e., vocal source signal) r'(n).

$$Q(z) = \frac{1}{1 + g_p \sum_{i=-1}^{1} pc(i) \cdot z^{-(i+T)}} \qquad \text{Equation (17)}$$

The synthesis filter 30 substitutes the obtained vocal source signal r'(n), as described above, into the equation (11) in stead of the r(n) to obtain an output voice s(n).

Note that the present embodiment uses a three-tap IIR filter for the pitch emphasis filter, but it is not limited as such and rather it may be possible to change a tap length or use other discretionary filters such as FIR filters.

As described above, the third embodiment emphasizes a pitch cycle component contained by a vocal source signal by further comprising a pitch emphasis filter in addition to the configuration of the first embodiment, thereby making it possible to improve voice clarity further as compared thereto. That is, restoring a vocal source characteristic (i.e., residual differential signal) and a vocal tract characteristic by separating an input voice code and applying emphasis processes respectively suitable thereto, i.e., emphasizing the pitch cyclicality for the vocal source characteristic while emphasizing formants for the vocal tract characteristics makes it possible to further improve the output voice clarity.

Figure 11:
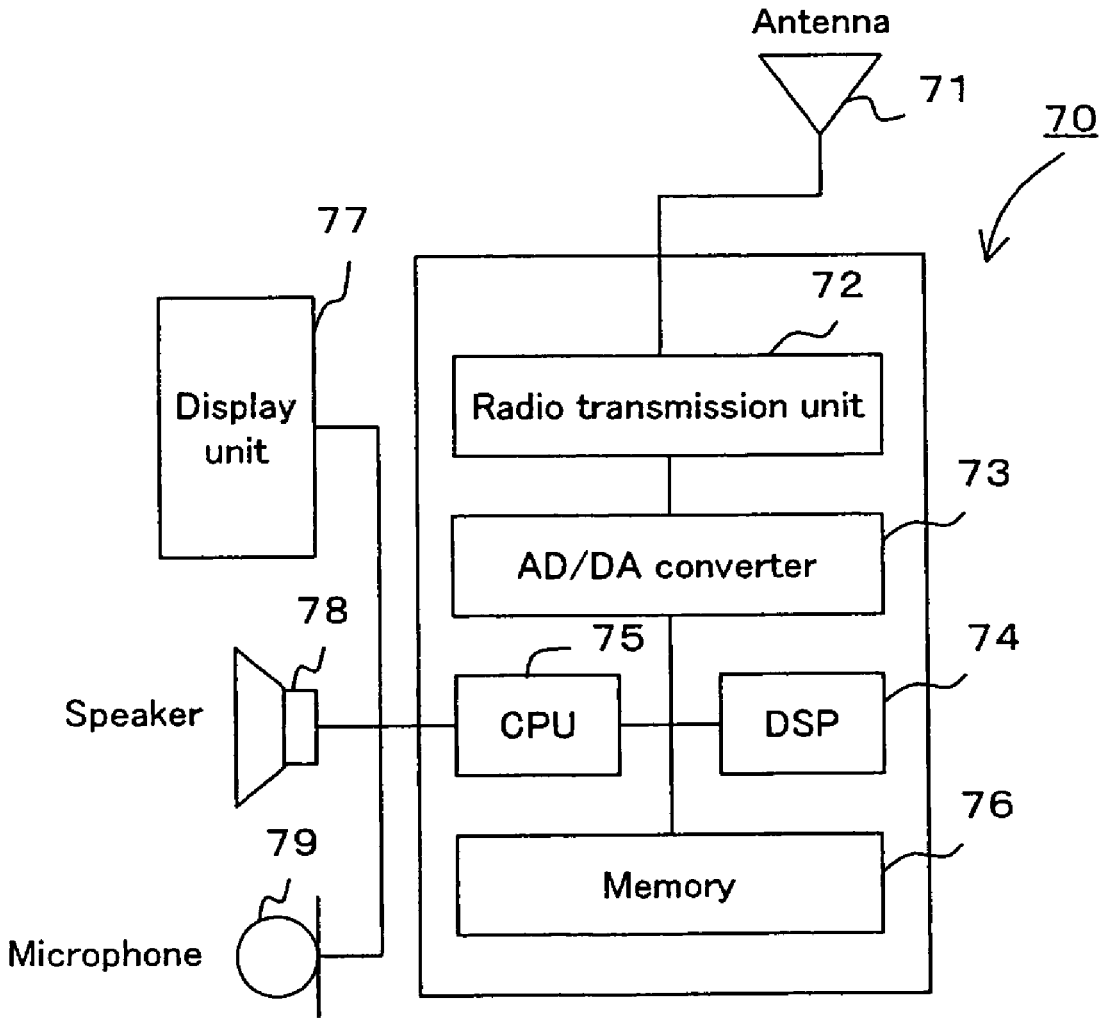
FIG. 11 shows a hardware configuration of a mobile phone as one of the applications of a speech decoder.

FIG. 11 shows a hardware configuration of a mobile phone/PHS (i.e., Personal Handy-phone System) as one application of a speech decoder of the present embodiment. Note that a mobile phone, capable of performing discretionary processing by executing a program, et cetera, can be considered as a sort of computer.

The mobile phone/PHS 70 shown by FIG. 11 comprises an antenna 71, a radio transmission unit 72, an AD/DA converter 73, a DSP (Digital Signal Processor) 74, a CPU 75, memory 76, a display unit 77, a speaker 78 and a microphone 79.

The DSP 74 executing a prescribed program stored in the memory 76 for a voice code code received by way of the antenna 71, radio transmission unit 72 and AD/DA converter 73 achieves the speech decoding processing described in reference to FIGS. 1 through 10 to output an output voice.

Also described above, the application of the speech decoder according to the present invention is in no way limited to the mobile phone, but may be VoIP (Voice over Internet Protocol) or a video conference system for example. That is, any kind of computer having the function of communicating by wired or wireless means by applying a voice coding method for compressing voice and capable of performing the speech decoding processing as described in reference to FIGS. 1 through 10.

Figure 12:
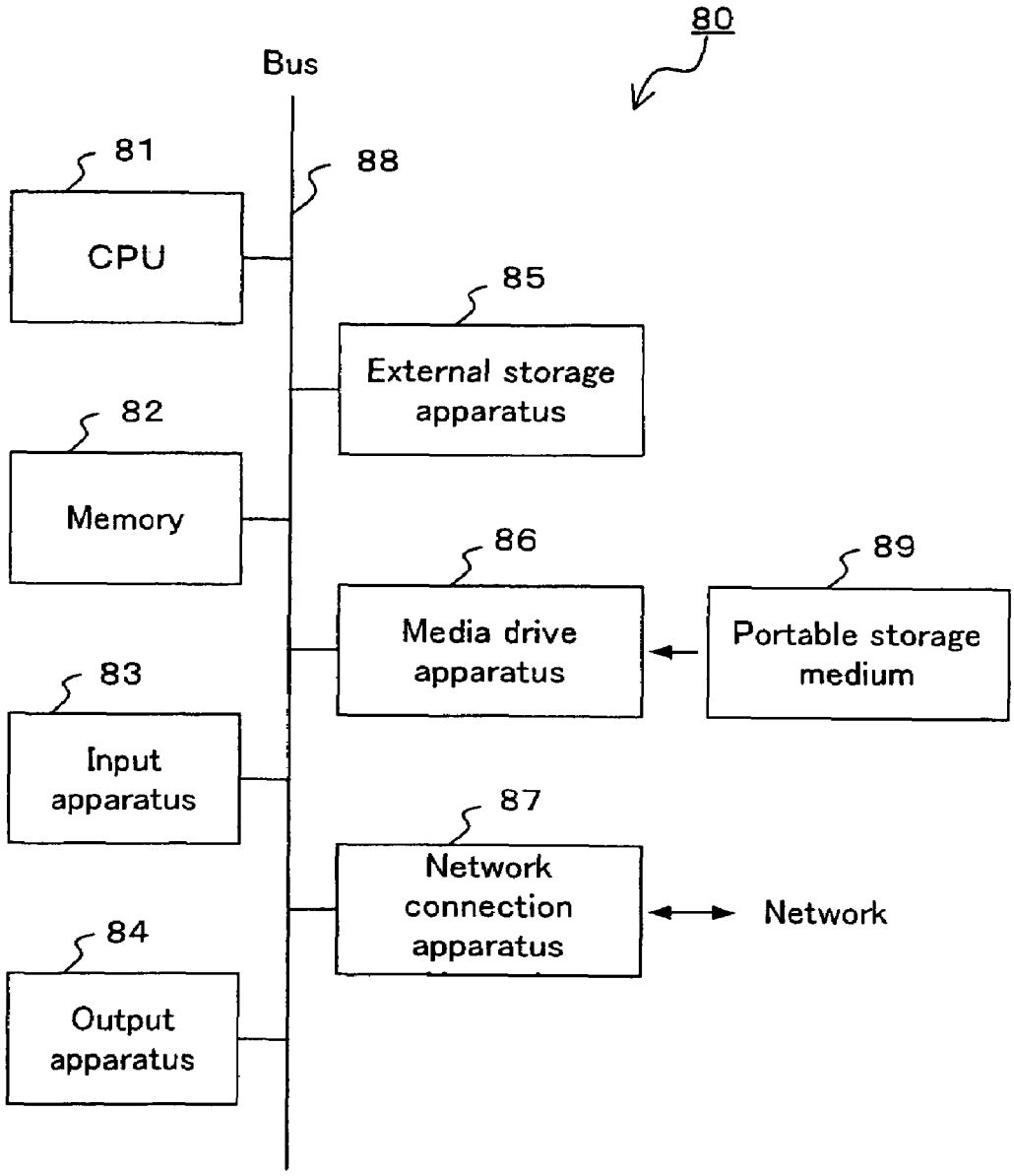
FIG. 12 shows a hardware configuration of a computer as one of applications of a speech decoder.

FIG. 12 exemplifies an overview of the hardware configuration of such a computer.

The computer 80 shown by FIG. 12 comprises a CPU 81, memory 82, an input apparatus 83, an output apparatus 84, an external storage apparatus 85, a media drive apparatus 86, and a network connection apparatus 87, and a bus 88 connecting the aforementioned components.

FIG. 12 exemplifies a generalized configuration that may vary.

The memory 82 is memory such as RAM for temporarily storing a program or data stored in the external storage apparatus 85 (or a portable storage medium 89) when executing the program or renewing the data.

The CPU 81 accomplishes the above described various processes and functions (i.e., the processes shown by FIGS. 4 and 8; and the functions of the respective functional units shown by FIGS. 1 through 3, 7 and 10) by executing the program loaded into the memory 82.

The input apparatus 83 comprises a keyboard, a mouse, a touch panel, a microphone, for example.

The output apparatus 84 comprises a display and a speaker, for example.

The external storage apparatus 85, comprises a magnetic disk, an optical disk and magneto optical disk apparatuses, stores the program and data, et cetera, for the speech decoder to accomplish the above described various functions.

The media drive apparatus 86 reads out the program and data stored in the portable storage medium 89. The portable storage medium 89 comprises an FD (Flexible Disk), a CD-ROM, and other media such as a DVD, a magneto optical disk, for example.

The network connection apparatus 87 is configured to enable the program and data exchanges with an external information processing apparatus by connecting with a network.

Figure 13:
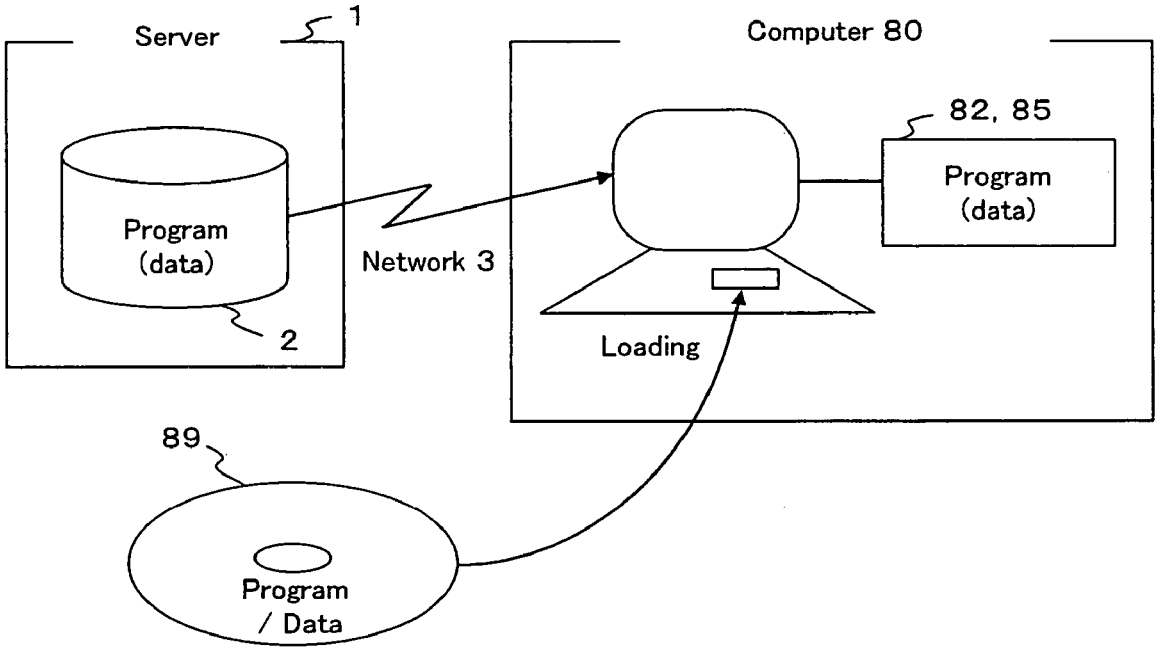
FIG. 13 exemplifies a storage medium storing a program and downloading of the program.

FIG. 13 exemplifies a storage medium storing the above described program and downloading of the program.

As shown by FIG. 13, a configuration may be such that the program and data for accomplishing the functions of the present invention are read from the portable storage medium 89 to the computer 80, stored in the memory and executed, or alternatively the aforementioned program and data stored in a storage unit 2 comprised by an external server 1 are downloaded through a network 3 (e.g., the Internet) by way of the network connection apparatus 87.

The present invention is not limited either by an apparatus or method, but it may be configured as a storage medium (e.g., portable storage media 89) per se storing the above described program and data, or as the above described program per se.

Lastly, let us describe the prior patent application (i.e., international application number JP02/11332) that has been applied for by the applicant of the present patent application.

Figure 14:
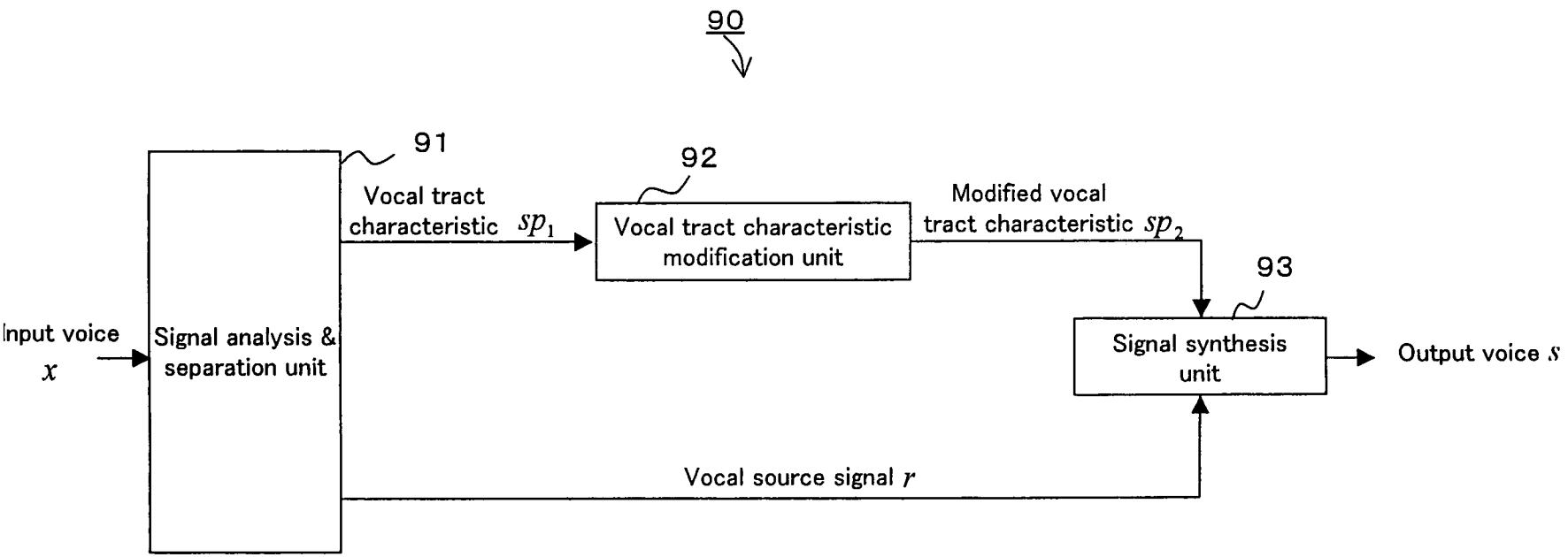
FIG. 14 shows the basic configuration of a speech emphasis apparatus proposed by the prior patent application.

FIG. 14 shows the basic configuration of speech emphasis apparatus 90 proposed by the prior patent application.

The speech emphasis apparatus 90 shown by FIG. 14 is characterized in such a way that a signal analysis/separation unit 91 first analyzes an input voice, x, and separates it into a vocal source signal, r, and a vocal tract characteristic $sp_1$; a vocal tract characteristic modification unit 92 modifies the vocal tract characteristic $sp_1$ (e.g., formant emphasis) and outputs the modified (i.e., emphasized) vocal tract characteristic $sp_2$; and lastly a signal synthesis unit 93 re-synthesizes the vocal source signal, r, with the above described modified (i.e., emphasized) vocal tract characteristic $sp_2$, thereby outputting a formant emphasized voice.

As described above, the prior patent application separates an input voice into a vocal source signal, r, and a vocal tract characteristic $sp_1$, followed by emphasizing the vocal tract characteristic, thereby avoiding the distortion of the vocal source signal that has been a problem associated with the method noted by the patent document 1. Therefore it is possible to apply formant emphasis without causing an increased sense of noisiness or decreased voice clarity.

Figure 15:
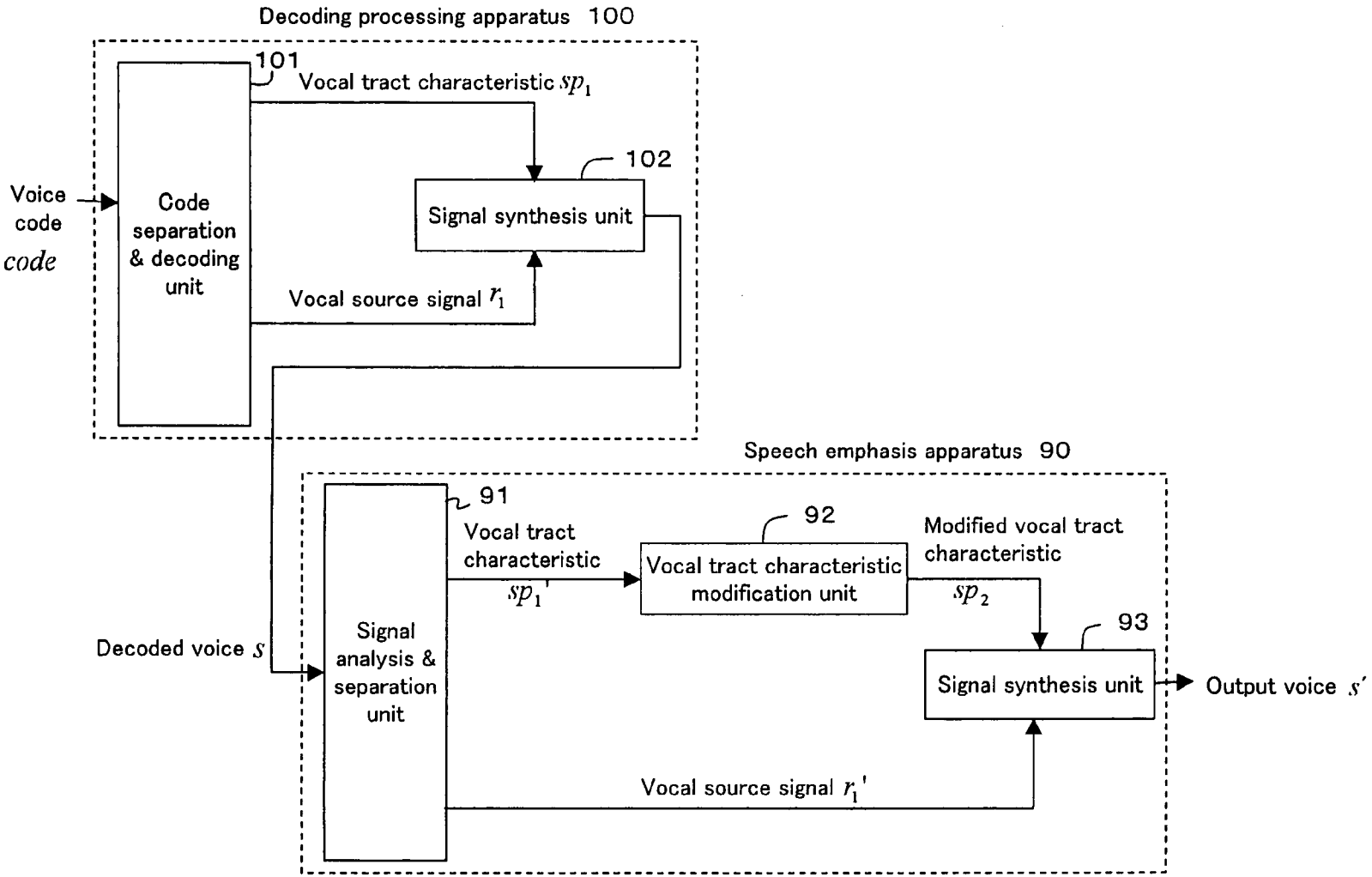
FIG. 15 exemplifies a configuration in the case of applying the speech emphasis apparatus proposed by the prior patent application to a mobile phone, et cetera, equipped with a CELP decoder.
Figure 16:
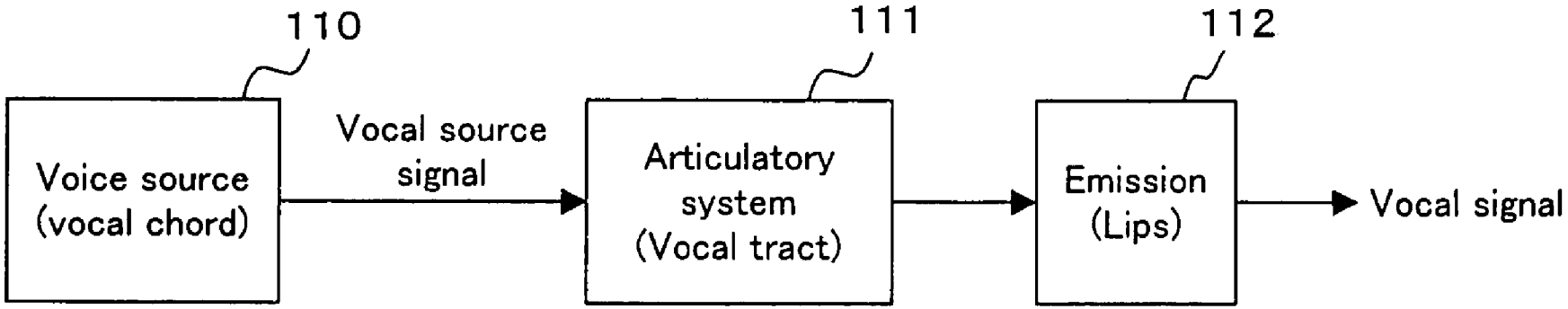
FIG. 16 shows a voice generation model.
Figure 17:
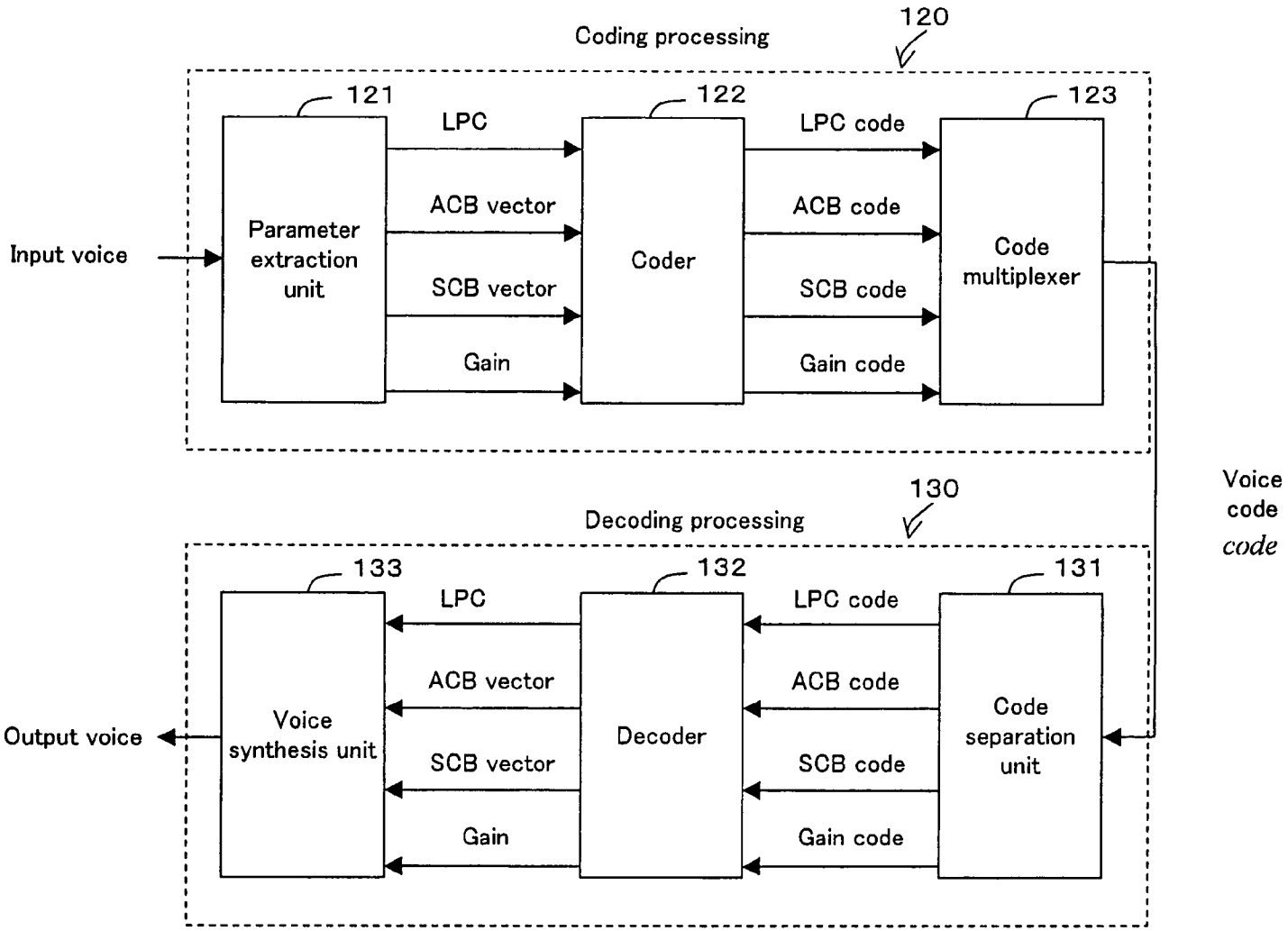
FIG. 17 shows the processing flow of CELP coder/decoder.
Figure 18:
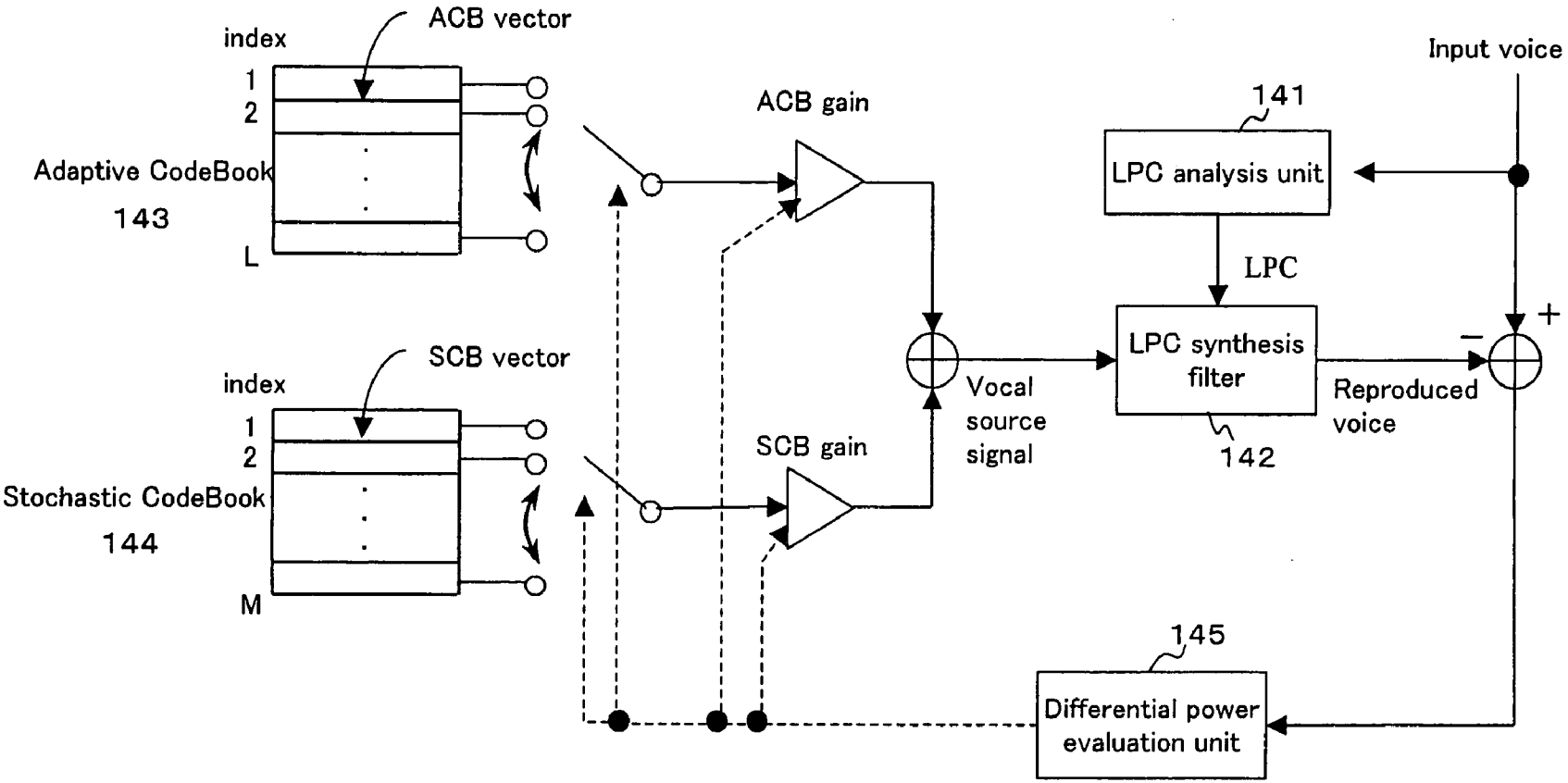
FIG. 18 shows a block diagram of the architecture of the parameter extraction unit comprised by a CELP decoder.

Incidentally, FIG. 15 exemplifies a configuration in the case of applying the speech emphasis apparatus presented by the prior patent application to a mobile phone, et cetera, equipped with a CELP decoder.

The speech emphasis apparatus 90 noted by the prior patent application, receiving a voice, x, as described above, comprises a decoding processing apparatus 100 in the front stage thereof for decoding a voice code code transmitted from the outside in the decoding processing apparatus 100 to input the decoded voice, s, to the speech emphasis apparatus 90 as shown by FIG. 15.

In the decoding processing apparatus 100 for instance, a code separation/decoding unit 101 generates a vocal source signal $r_1$ and a vocal tract characteristic $sp_1$ from the voice code code and a signal synthesis unit 102 synthesize them to generates and outputs a decoded voice, s. In the process, the decoded voice, s, has its information compressed and therefore the amount of information is reduced as compared to the voice prior to the coding and accordingly is of poor quality.

Because of the above, having received the decoded voice, s, of a degraded quality, the speech emphasis apparatus 90 re-analyzes the voice of a degraded quality to separate a vocal source signal and a vocal tract characteristic. This then causes a degraded separation accuracy, sometimes resulting in a vocal source signal component remaining in a vocal tract characteristic $sp_1'$ which is separated from the decoded voice, s, or a vocal tract characteristic which remains in a vocal source signal $r_1'$. Therefore, there is a possibility of emphasizing a vocal source signal component remaining in the vocal tract characteristic, or failing to emphasize a vocal tract characteristic remaining in the vocal source signal, when the vocal tract characteristic is emphasized. This in turn has made it possible to degrade the quality of output voice s' having been re-synthesized from the vocal source signal and the formant emphasized vocal tract characteristic.

Contrary to the above described, the speech decoder according to the present invention uses a vocal tract characteristic decoded from a voice code, eliminating the case of quality degradation due to a re-analysis of a degraded voice. Furthermore, an elimination of re-analysis makes it possible to reduce the processing load.

As described in detail above, the speech decoder, decoding method and the program, in a communication apparatus such as mobile phone using a voice coding method in an analysis-synthesis system, having received a voice code which has been processed with a voice coding prior to the transmission, restores a vocal tract characteristic and a vocal source signal from the voice code, applies formant emphasis to the restored vocal tract characteristic to synthesize it with the vocal source signal when generating and outputting a voice based on the voice code. This suppresses distortion of the spectrum occurring when a vocal tract characteristic and a vocal source signal are simultaneously emphasized that has been a problem with the conventional technique, thereby making it possible to improve the clarity. That is, it is possible to decode a voice without causing a second effect such as a degradation of voice quality or an increased sense of noisiness, enabling ease of hearing with improved voice clarity.

What is claimed is:

1. A speech decoder, comprising:

a code separation/decoding unit for restoring a vocal tract characteristic and a vocal source signal by separating a received voice code;

a formant estimation unit for estimating a plurality of formants in said vocal tract characteristic;

an amplification ratio calculation unit for calculating a plurality of amplification ratios, each corresponding to each of the plurality of estimated formants, for the vocal tract characteristic based on the plurality of estimated formants;

an emphasis unit for emphasizing the vocal tract characteristic based on the calculated plurality of amplification ratios; and a signal synthesis unit for outputting a voice signal by synthesizing the modified vocal tract characteristic modified by the emphasis unit and the vocal source signal obtained from the voice code, wherein said formant estimation unit estimates a plurality of pairs, each having a formant frequency and a formant amplitude at said formant frequency, each of the plurality of pairs corresponds to each of the plurality of estimated formants, said amplification ratio calculation unit calculates a constant amplification reference power from said vocal tract characteristic and determines the plurality of amplification ratios of the respective plurality of formants so as to match the formant amplitude of each pair of the plurality of pairs with the same constant amplification reference power, and said emphasis unit emphasizes the vocal tract characteristic by using each of the plurality of amplification ratios of each of the respective plurality of formants.

2. The speech decoder according to claim 1, wherein said amplification ratio calculation unit further obtains an amplification ratio of a frequency band between two of the plurality of formants from an interpolation curve, and said emphasis unit emphasizes said vocal tract characteristic by also using the amplification ratio obtained from the interpolation curve.

3. The speech decoder according to claim 1, wherein said amplification ratio calculation unit calculates a quotient as each of the plurality of amplification ratios by dividing the same constant amplification reference power by the formant amplitude included in each of the plurality of pairs.

4. A speech decoding method, comprising the steps of:

restoring a vocal tract characteristic and a vocal source signal by separating a received voice code;

estimating a plurality of formants in said vocal tract characteristic;

calculating a plurality of amplification ratios, each corresponding to each of the plurality of estimated formants, for the vocal tract characteristic based on the plurality of estimated formants;

emphasizing the vocal tract characteristic based on the calculated plurality of amplification ratios; and outputting a voice signal by synthesizing the modified vocal tract characteristic modified by the emphasizing step and the vocal source signal obtained from the voice code, wherein said estimating step includes estimating a plurality of pairs, each having a formant frequency and a formant amplitude at said formant frequency, each of the plurality of pairs corresponds to each of the plurality of estimated formants, said calculating step includes calculating a constant amplification reference power from said vocal tract characteristic and determining the plurality of amplification ratios of the respective plurality of formants so as to match the formant amplitude of each pair of the plurality of pairs with the same constant amplification reference power, and said emphasizing step includes emphasizing the vocal tract characteristic by using each of the plurality of amplification ratios of each of the respective plurality of formants.

5. The speech decoding method according to claim 4, wherein said calculating step further includes obtaining an amplification ratio of a frequency band between two of the plurality of formants from an interpolation curve, and said emphasizing step emphasizes said vocal tract characteristic by also using the amplification ratio obtained from the interpolation curve.

6. The speech decoding method according to claim 4, wherein said calculating step includes calculating a quotient as each of the plurality of amplification ratios by dividing the same constant amplification reference power by the formant amplitude included in each of the plurality of pairs.

7. A program embodied in a computer-readable medium, comprising instructions for performing the steps of:

restoring a vocal tract characteristic and a vocal source signal by separating a received voice code;

estimating a plurality of formants in said vocal tract characteristic;

calculating a plurality of amplification ratios, each corresponding to each of the plurality of estimated formants, for the vocal tract characteristic based on the plurality of estimated formants;

emphasizing the vocal tract characteristic based on the calculated plurality of amplification ratios; and outputting a voice signal by synthesizing the modified vocal tract characteristic modified by the emphasizing step and the vocal source signal obtained from the voice code, wherein said estimating step includes estimating a plurality of pairs, each having a formant frequency and a formant amplitude at said formant frequency, each of the plurality of pairs corresponds to each of the plurality of estimated formants, said calculating step includes calculating a constant amplification reference power from said vocal tract characteristic and determining the plurality of amplification ratios of the respective plurality of formants so as to match the formant amplitude of each pair of the plurality of pairs with the same constant amplification reference power, and said emphasizing step includes emphasizing the vocal tract characteristic by using each of the plurality of amplification ratios of each of the respective plurality of formants.

8. The program according to claim 7, wherein said calculating step further includes obtaining an amplification ratio of a frequency band between two of the plurality of formants from an interpolation curve, and said emphasizing step emphasizes said vocal tract characteristic by also using the amplification ratio obtained from the interpolation curve.

9. The program according to claim 7, wherein said calculating step includes calculating a quotient as each of the plurality of amplification ratios by dividing the same constant amplification reference power by the formant amplitude included in each of the plurality of pairs.

* * * * *